US010260832B2

(12) United States Patent
Bowe, Jr. et al.

(10) Patent No.: US 10,260,832 B2
(45) Date of Patent: Apr. 16, 2019

(54) GUN MOUNTING LOCK HAVING TWO PIVOTABLE ARMS

(71) Applicant: ESMET, INC., Canton, OH (US)

(72) Inventors: Timothy L. Bowe, Jr., Canton, OH (US); Craig A. Pugh, Canton, OH (US); Michael E. Waryas, Canton, OH (US)

(73) Assignee: Esmet, Inc., Canton, OH (US)

( * ) Notice: Subject to any disclaimer, the term of this patent is extended or adjusted under 35 U.S.C. 154(b) by 145 days.

(21) Appl. No.: 15/285,859

(22) Filed: Oct. 5, 2016

(65) Prior Publication Data

US 2018/0094892 A1 Apr. 5, 2018

(51) Int. Cl.

| | |
|---|---|
| ***F41A 23/18*** | (2006.01) |
| ***F41A 23/00*** | (2006.01) |
| ***E05B 73/00*** | (2006.01) |
| ***E05B 47/00*** | (2006.01) |
| ***E05B 19/00*** | (2006.01) |
| ***E05B 29/00*** | (2006.01) |
| ***F41C 33/04*** | (2006.01) |

(52) U.S. Cl.

CPC ..... *F41A 23/18* (2013.01); *E05B 19/00* (2013.01); *E05B 29/0013* (2013.01); *E05B 47/0012* (2013.01); *E05B 73/00* (2013.01); *F41A 23/005* (2013.01); *F41C 33/041* (2013.01)

(58) Field of Classification Search

CPC .. E05B 73/00; E05B 47/0012; E05B 29/0013; E05B 19/00; F41A 23/18; F41A 23/005

USPC ..... 70/14–19, 58

See application file for complete search history.

(56) References Cited

U.S. PATENT DOCUMENTS

| | | | | | |
|---|---|---|---|---|---|
| 611,401 | A | | 9/1898 | White | |
| 691,941 | A | * | 1/1902 | Headson | E05B 75/00 70/17 |
| 863,298 | A | * | 8/1907 | Malcolm | E05B 75/00 70/17 |
| 1,116,329 | A | * | 11/1914 | Russell | E05B 75/00 70/16 |
| 1,197,549 | A | * | 9/1916 | Russell | E05B 75/00 70/17 |
| 2,383,077 | A | * | 8/1945 | Powell | E05B 75/00 70/17 |
| 3,855,825 | A | | 12/1974 | Pickard | |
| 3,918,278 | A | | 11/1975 | Spear | |

(Continued)

*Primary Examiner* — Suzanne L Barrett

(74) *Attorney, Agent, or Firm* — Sand, Sebolt & Wernow Co., LPA

(57) ABSTRACT

A gun mounting lock and a method of using the same to secure a gun to a support surface. The gun mounting lock includes first and second arms positioned opposite each other and a ratchet assembly positioned between lower ends of the arms. The ratchet assembly engages gears provided on the lower ends of the arms. When the assembly is pushed downwardly by placing part of a gun thereon, the downward movement of the assembly causes the two arms to pivot towards each other simultaneously, capturing the gun between the arms and the assembly. The assembly is locked against movement in the reverse direction by a pin of a solenoid contacting a toothed flange on one of the arms. The assembly can be unlocked using a key or by providing power to the solenoid. The gun mounting lock housing is adjustably engaged with a track mounted on the support surface.

28 Claims, 20 Drawing Sheets

(56) References Cited

U.S. PATENT DOCUMENTS

| | | | | |
|---|---|---|---|---|
| 4,226,399 | A | 10/1980 | Henderson | |
| 4,269,049 | A | 5/1981 | Henderson | |
| 5,802,889 | A | 9/1998 | Arnold | |
| 5,934,112 | A | 8/1999 | Rice et al. | |
| 7,047,771 | B2 | 5/2006 | Tanos | |
| 8,307,676 | B2 * | 11/2012 | Irisawa | F41B 15/02 128/846 |
| 8,365,558 | B2 * | 2/2013 | Garibaldi | E05B 75/00 119/756 |
| 8,371,004 | B2 | 2/2013 | Huber et al. | |
| 8,794,454 | B2 | 8/2014 | Bleazard | |
| 8,991,224 | B2 | 3/2015 | Zalavari | |
| 9,915,283 | B2 * | 3/2018 | Chen | F16B 47/006 |
| 2006/0048551 | A1 * | 3/2006 | Tanos | E05B 15/0046 70/18 |
| 2013/0333425 | A1 * | 12/2013 | Krelle | E05B 75/00 70/16 |

* cited by examiner

GUN MOUNTING LOCK HAVING TWO PIVOTABLE ARMS

BACKGROUND

Technical Field

The present disclosure relates generally to devices for securing guns. More particularly, the present disclosure is directed to a gun mounting lock that is secured to a support surface and which captures part of a gun therein and securely retains the gun adjacent the support surface. Specifically, the invention is directed to a gun mounting lock having two arms and a plunger that is operatively engaged with the two arms; and wherein depressing the plunger (by placing part of a gun on the same) causes the arms to pivot towards each other into a closed position and thereby capture the part of the gun.

Background Information

Gun safes, gun display racks and other types of support surfaces are typically provided with some type of gun mounting lock that serves a dual purpose. The gun mounting lock provides a way to physically mount the gun on support surface as well as securely locking the gun in place so that the gun may not be disengaged therefrom by unauthorized persons.

Gun mounting locks are typically configured to mount and secure a single specific type of gun or one or two specific types of guns. These types of gun mounting locks usually cannot secure other differently configured guns.

In many jurisdictions, police officers carry an AR-15 as well as a shotgun and because these are two quite differently configured weapons, a police cruiser may need to be provided with two different gun mounting locks to secure the individual weapons. This problem has been somewhat addressed in the art by providing gun mounting locks that may be capable of mounting and securing more than one type of gun therein.

U.S. Pat. No. 4,226,399 to Henderson, for example, discloses a lock that is designed to encircle a gun barrel. The lock includes two jaws that are mounted opposite each other on a housing. One of the jaws is rotatable while the other jaw may be fixed or rotatable. The lower end of each jaw may be provided with teeth that interlock with teeth on the opposing jaw so that the jaws move in synchrony with each other. A key is used to move the jaws to the open position. The disclosed gun mounting lock is designed to receive a barrel of a gun therein but the shape of the space between the jaws and the longitudinally elongate nature of the jaws may prevent certain types of weapons from being secured by this gun mounting lock.

U.S. Pat. No. 5,802,889 (Arnold) discloses a bicycle lock that includes a U-shaped housing that is fixedly engaged via a mounting to a portion of a support surface (in this instance, a bicycle frame). The housing bounds and defines a U-shaped space that is accessible through an entrance defined between two opposed free ends of the housing. A curved arm is received in a channel formed in one section of the housing and the arm is operatively engaged by way of a gear mechanism to a plunger. The interior surface of the housing opposite the entrance defines a hole therein and the plunger's shaft is received through that hole. The shaft is provided with teeth that mesh with a gear mechanism in the channel defined in the housing and thereby with the arm. When the plunger is depressed downwardly toward the bottom interior surface of the housing, the gear mechanism is actuated to move the curved arm out of an opening in one free end of the U-shaped housing. The arm is caused to move across the entrance and to engage in a lock on the opposed free end of the housing. The movement of the arm closes off access to housing through the entrance. If a gun barrel was placed on the plunger, the movement of the arm will secure the gun barrel between the plunger and the arm. When the lock is disengaged and the barrel is removed from the plunger, a spring in the plunger will cause the plunger to return to its non-depressed position and this movement will cause the arm to be slid back into the channel of the housing.

U.S. Pat. No. 5,934,112 (Rice et al) discloses a "handcuff" style gun mounting lock that has a base that is securable to a support surface. A C-shaped housing extends outwardly from the base and a swingable arm is pivotally engaged with an upper end of the housing. The arm has ratchet teeth formed on an exterior surface thereof. When the arm is pivoted to engage the housing; the ratchet teeth interlock with a ratchet assembly provided on the housing. A key must be employed to disengage the ratchet teeth from the ratchet assembly to unlock the gun mounting lock and release a gun barrel captured in a space defined between the housing and the arm.

U.S. Pat. No. 7,047,771 (Tanos) and U.S. Pat. No. 8,991,224 (Zalavari) disclose "handcuff style" gun mounting locks. These locks have a fixed C-shaped housing with a swingable arm that is pivotally engaged to one end of the housing. The arm is pivotable in a first direction to permit access to a C-shaped recess defined by the housing; and is pivotable in a second direction to block access to the C-shaped recess. When the arm is pivoted in the second direction, the arm's free end moves into a channel defined in the housing and is locked to the housing by a suitable locking mechanism. These patents disclose that the locking mechanism may be a ratchet type lock where a plurality of teeth are provided on a surface of the arm and these teeth engage a ratchet latch on the housing. The ratchet latch may be activated by a solenoid or by a key.

Bleazard (U.S. Pat. No. 8,794,454) discloses a bicycle lock that includes a pair of locking arms that are mounting to pivot toward each other to capture part of a bicycle frame between them. The locking arms pivot away from each other to release the part of the bicycle frame. Each arm is generally C-shaped and the lower ends thereof curve upwardly into a space defined by the opposed arms. The part of the bicycle frame is rested on these lower ends and depressing the lower ends downwardly causes the arms to pivot about pivot rods spaced a distance outwardly from the lower ends. The pivotal motion generated by depressing the lower ends of the arms causes the upper ends of those arms to rotate towards each other. A locking mechanism is provided to prevent the arms from accidentally rotating away from each other.

SUMMARY

While the prior art discloses a number of weapon mounting systems that include gun mounting locks that are able to secure more than one type of gun, there remains a need in the art for a gun mounting lock that is able to mount and secure a wider range of gun types therein. The gun mounting lock disclosed herein addresses some of the short-comings of the prior art.

A gun mounting lock and a method of using the same to secure a gun to a support surface are disclosed herein. The gun mounting lock includes first and second arms positioned opposite each other and a ratchet assembly positioned between lower ends of the arms. The ratchet assembly engages gears provided on the lower ends of the arms. When the assembly is pushed downwardly by placing part of a gun thereon, the downward movement of the assembly causes the two arms to pivot towards each other simultaneously, capturing the gun between the arms and the assembly. The assembly is locked against movement in the reverse direction by a pin of a solenoid contacting a toothed flange on one of the arms. The assembly can be unlocked using a key or by providing power to the solenoid. The gun mounting lock housing is adjustably engaged with a track mounted on the support surface.

In one aspect, a gun mounting lock may comprise a housing; a first arm rotatably mounted on the housing; a second arm rotatably mounted on the housing; wherein the first arm is opposed to the second arm; a ratchet assembly provided on the housing; said ratchet assembly being operatively engaged with both of the first arm and the second arm; wherein the ratchet assembly is movable relative to the housing and when the ratchet assembly is moved in a first direction the first and second arms pivot in unison towards each other; and when the ratchet assembly is moved in a second direction the first and second arms pivot in unison away from each other.

In another aspect, a gun mounting lock may comprise a first arm; a second arm positioned opposite the first arm; a plunger positioned between a lower end of the first arm and a lower end of the second arm; said plunger being operatively engaged with the lower ends of each of the first and second arms; wherein the plunger is movable in a first direction or a second direction; and when the plunger is moved in the first direction, an outer end of the first arm and an outer end of the second arm are caused to move towards each other; and when the plunger is moved in the second direction, the outer ends of the first and second arms move away from each other. The plunger moves linearly in the first direction and in the second direction; and wherein the linear motion of the plunger is translated to rotational motion of the first and second arms. The plunger may be a ratchet assembly comprising a base having a first side located opposite the lower end of the first arm; and a second side that is located opposite the lower end of the second arm; wherein each of the first and second sides includes one or more ratchet teeth; and wherein the one or more ratchet teeth on the first side operatively engage a first gear on the first arm; and the one or more ratchet teeth on the second side operatively engage a second gear on the second arm. The first and second gears may be integrally formed as part of the first arm and the second arm, respectively.

In another aspect, a method of using a gun mounting lock to secure a gun to a support surface may comprise providing a gun mounting lock comprising a first arm; a second arm positioned opposite the first arm; and a plunger positioned between and operatively engaged with a lower end of the first arm and a lower end of the second arm; placing a part of the gun onto an upper surface of the plunger; applying a downward force on the upper surface of the plunger; moving the plunger downwardly; translating the downward motion of the plunger into rotational motion of the lower ends of the first arm and the second arm; rotating the lower end of the first arm about a first axis; rotating the lower end of the second arm about a second axis; pivoting an upper end of the first arm towards an upper end of the second arm; pivoting the upper end of the second arm toward the upper end of the second arm; and capturing the part of the gun between the upper ends of the first and second arms and the upper surface of the plunger.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims.

FIG. 20 is a front elevation view of the gun mounting lock with a front half of the housing removed and showing a gun barrel being removed from the ratchet assembly and the gun mounting lock shown moving from the closed position to the open position.

Similar numbers refer to similar parts throughout the drawings.

DETAILED DESCRIPTION

Figure 1:
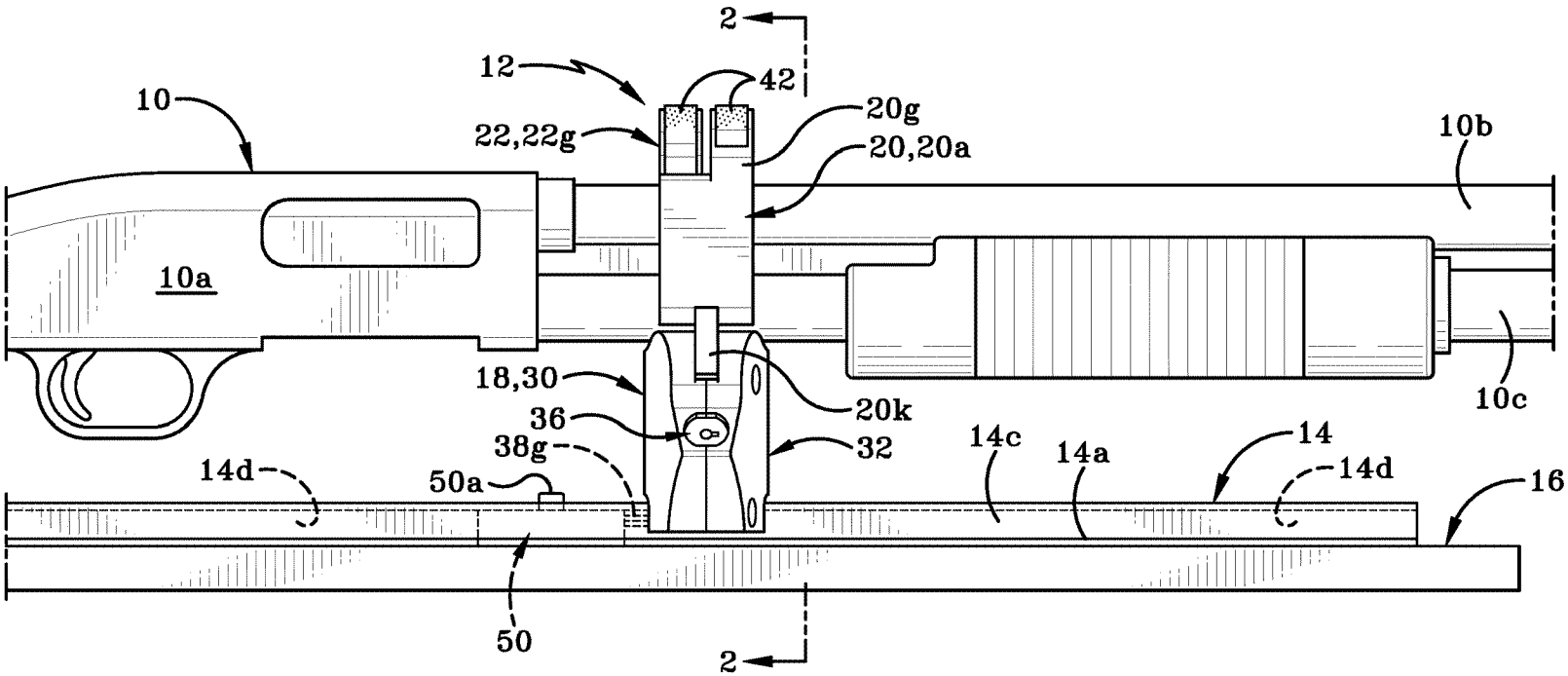
FIG. 1 is a left side elevation view of a gun mounting lock retaining a gun therein.

Referring to FIG. 1 there is shown a gun 10 secured by way of a gun mounting lock 12 and a track 14 in accordance with an aspect of the present invention to a support surface 16. Gun 10 may include a stock 10*a* and one or more barrels, such as barrels 10*b*, 10*c*, that extend outwardly and forwardly from stock 10*a*. FIG. 1 shows barrels 10*b*, 10*c* engaged and retained by gun mounting lock 12. It will be understood that one or more substantially identical gun mounting locks 12 may be utilized to secure gun 10 to track 14. Track 14 may be fixedly engaged to a support surface 16 such as an interior roof frame of a police cruiser or to a wall of a gun safe or a display rack. FIG. 1 shows gun mounting lock 12 holding gun 10 in a position above a horizontally oriented track 14. It will be understood that track 14 and gun mounting lock 12 may be oriented to suspend gun 10 below support surface 16. Furthermore, track 14 may be mounted on a vertically oriented support surface 16 or on an inclined support surface 16 and gun mounting lock 12 will secure gun in an orientation that is generally parallel to the support surface 16.

Figure 2:
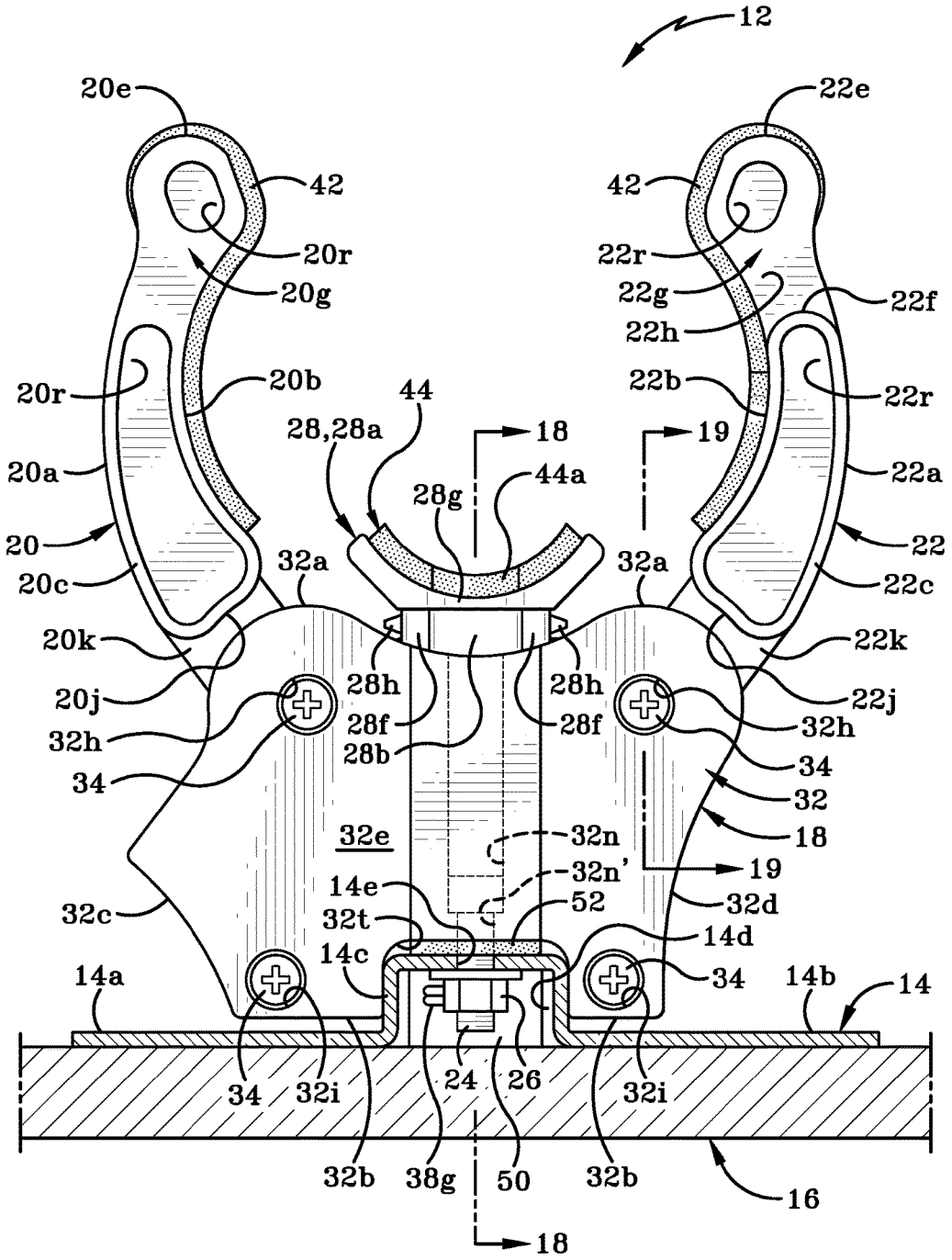
FIG. 2 is a front elevation view of the gun mounting lock shown in the open position taken along line 2-2 of FIG. 1.
Figure 3:
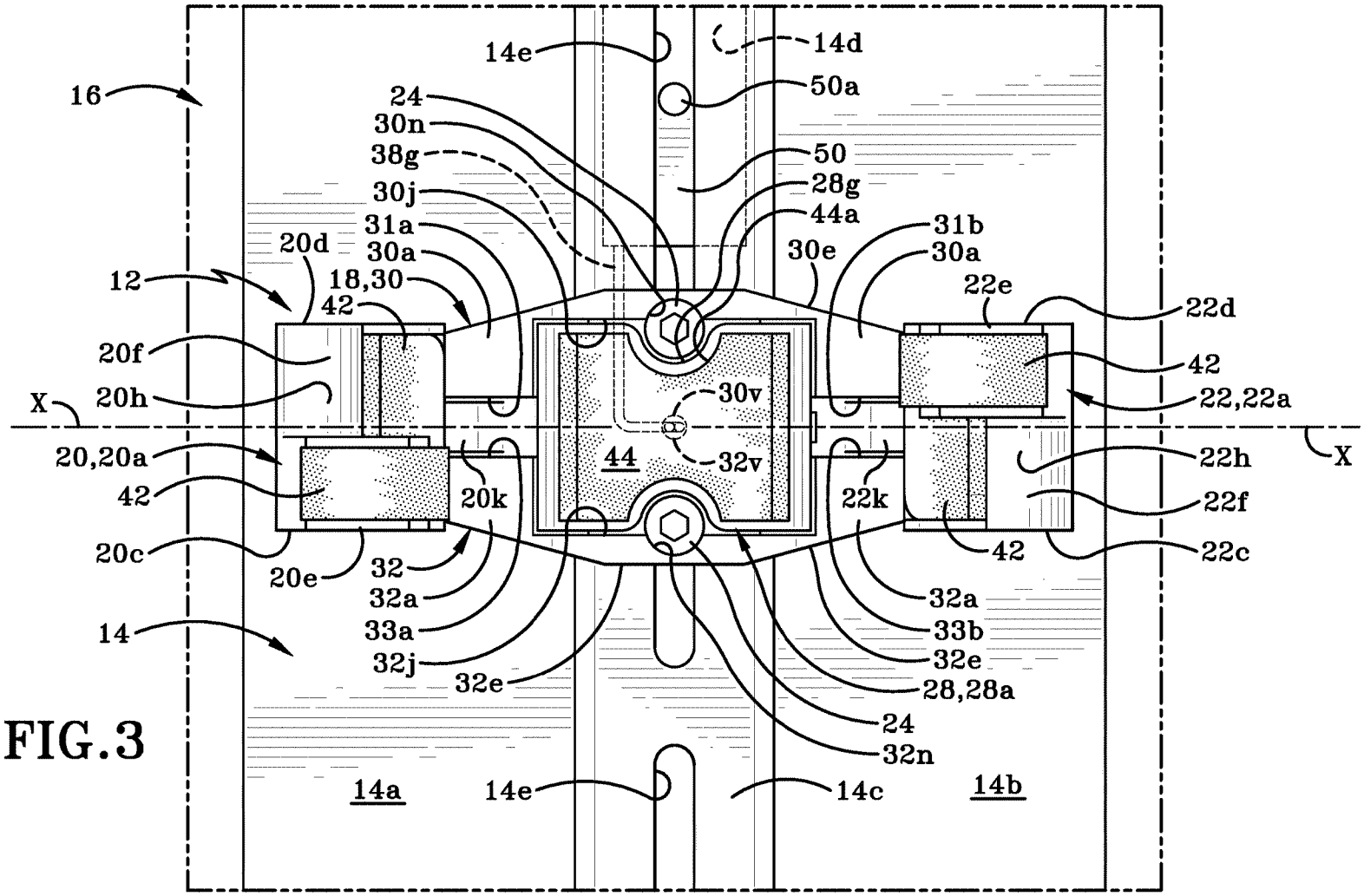
FIG. 3 is a top plan view of the gun mounting lock shown engaged on a track.
Figure 4:
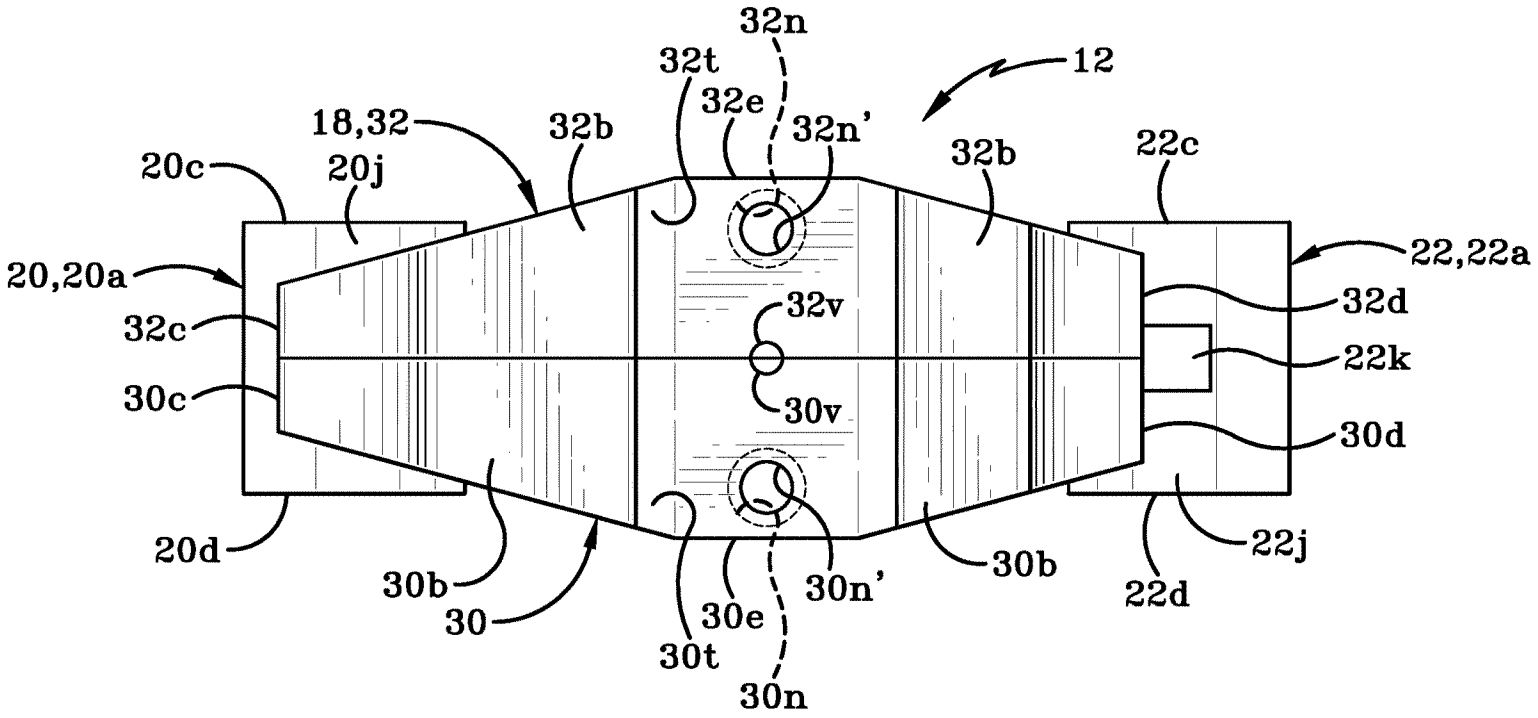
FIG. 4 is a bottom plan view of the gun mounting lock of FIG. 3 with the track and padding removed for clarity.

As shown in FIGS. 2 and 3, track 14 may comprise an elongate metal bar having a first side section 14*a*, a second side section 14*b* and a central U-shaped projection 14*c* that extends upwardly and outwardly beyond the upper surfaces of first and second side sections 14*a*, 14*b*. Projection 14*c* may run for substantially the entire length of track 14 from a first end thereof to a second end thereof. The upper surfaces of first side section 14*a* and second side section may be substantially aligned with each other. The lower surfaces of first side section 14*a* and second side section 14*b* may be substantially aligned with each other and abut an outer surface of support surface 16. A cavity 14*d* is defined by U-shaped projection 14*c*. A plurality of longitudinally-elongate slots 14*e* may be defined in a central region of projection 14*c* and slots 14*e* may be in communication with cavity 14*d*. Slots 14*e* may be used to secure gun mounting lock 12 to track 14 (as will be described hereafter) and the elongate nature of slots 14*e* provides for adjustable positioning of gun mounting lock 12 on track 14. It will be understood that track 14 may be secured to support surface 16 in any suitable manner such as by way of a plurality of fasteners, by welding or by an adhesive.

Referring to FIGS. 2-7, gun mounting lock 12 may include a housing 18, a first arm 20 and a second arm 22. Housing 18 may be secured to track 14 by way of mounting screws 24 that are inserted through slots 14*e* and nuts 26 that lock mounting screws 24 to track 14, as will be described further herein. Gun mounting lock 12 may further comprises a control arm 28 that is operatively engaged with each of first and second arms 20, 22. Control arm 28 may control the pivotal motion of first and second arms 20, 22 toward each other and/or away from each other. The control arm may take the form of a plunger that is operatively engaged with first and second arms 20, 22. The plunger may be located centrally between the lower ends of first and second arms 20, 22 and be operatively engaged with the lower ends. When the plunger is moved linearly in a first direction relative to an outer wall of housing 18, first and second arms 20, 22 pivot towards each other. When the plunger is moved linearly in a second direction relative to the outer wall of housing 18, first and second arms 20, 22 pivot away from each other. (In other instances, if the first and second arms 20, 22 pivot away from each other, the plunger may be moved by its engagement with the lower ends of first and second arms 20, 22 in a second direction relative to the outer wall of the housing 18.) In some instances, when the plunger is depressed inwardly towards an outer wall of the housing 18, first and second arms 20, 22 pivot towards each other and close around a gun barrel.

The plunger may take the form of a ratchet assembly that is positioned between the lower ends of first and second arms 20, 22 and is able to move upwardly and downwardly relative to the outer wall of housing 18. The ratchet assembly 18 may include teeth that mesh with teeth on gears provided on each of first and second arms 20, 22. As will be described later herein, the gears may take the form of mounting hubs that are integrally molded as part of the body of the first arm 20 or the second arm 22. Although not illustrated herein, it will be understood that in other instances separate gears may be fixedly mounted to lower ends of the first and second arms 20, 22. The linear movement of ratchet assembly 28 is translated into pivotal motion of first and second arms 20, 22 and vice versa. The control arm will be referred to in the following description by the term "ratchet assembly 28" but it should be understood that the terms "control arm", "plunger" and "ratchet assembly" may be used interchangeably.

Housing 18 may comprise a first housing section 30 and a second housing section 32. Each of the first and second housing sections 30, 32 may be molded components that may be formed in any desired shape, such as the shapes illustrated in FIG. 7. First and second housing sections 30, 32 are configured to be complementary to each other and to be secured to each other by fasteners 34 or by any other suitable means. It should be understood that each of the first and second housing sections 30, 32 is molded to form partial walls, projections, recesses, apertures, channels etc. that, when the housing sections 30, 32 are engaged with each other, will form complete walls, projections, recesses, apertures, channels etc. for the various internal components of gun mounting lock 12.

Preferably, first and second arms 20, 22, ratchet assembly 28 and first and second housing sections may be fabricated from a strong material such as a metal so that it is difficult for an unauthorized person to damage or break the same in order to release a gun from gun mounting lock 12.

First housing section 30 may comprise a top wall 30*a*, a bottom wall 30*b*, a first side wall 30*c*, a second side wall 30*d*, and an end wall 30*e*. The walls 30*a*-30*e* bound and define a cavity 30*f*. (It will be understood that the terms top, bottom, upper, lower, upward, downwardly, front, back, etc. are used herein to describe relationships between components of gun mounting lock 12 as illustrated in the attached figures. These terms should not be construed to describe an orientation in which the gun mounting lock 12 or the components thereof have to be arranged.)

A pair of hubs 30*g* extends outwardly from an interior surface of end wall 30*e*, a short distance downwardly from top wall 30*a*. A first one of the hubs 30*g* is located proximate first side wall 30*c* and the second one of the hubs 30*g* is located proximate second side wall 30*d*. Hubs 30*g* may be oriented generally at right angles to the interior surface of end wall 30*e*. Each hub 30*g* comprises a first hub section 30*g*' that is of a first diameter and a second hub section 30*g*" that is of a second diameter, where the second diameter is greater than the first diameter. First hub 30*g* also defines an aperture 30*h* therein that is threaded and extends for a distance inwardly into one or both of the first hub section 30*g*' and 30*g*".

Figure 18:
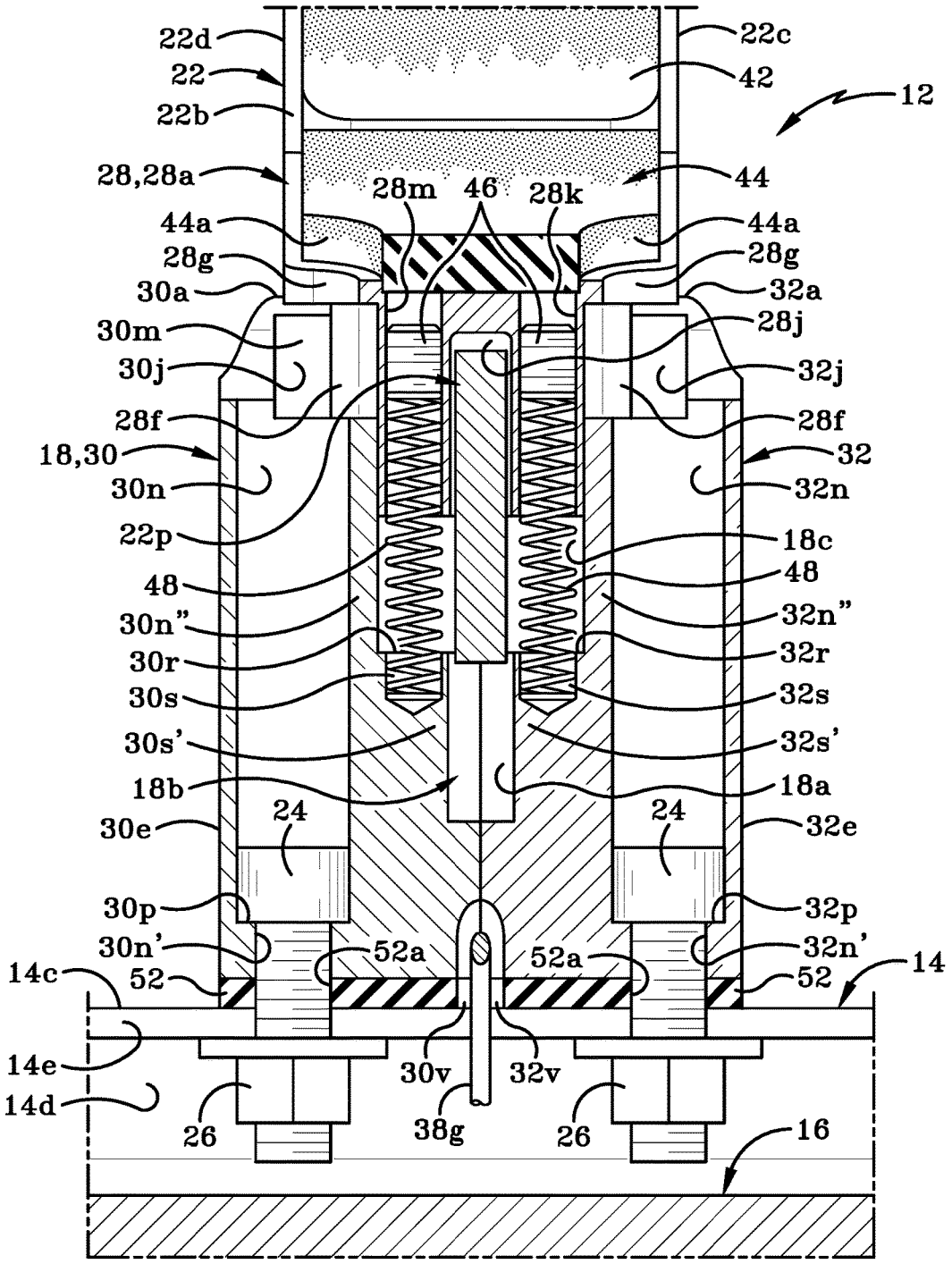
FIG. 18 is a partial cross-section of the right locking arm taken along line 18-18 of FIG. 2 and with the power pack and some of the wiring omitted for clarity.

A threaded first aperture 30*i* and a threaded second aperture 30*i* may defined in end wall 30*e* proximate bottom wall 30*b*; each of the apertures 30*i* may be located proximate one or the other of first side wall 30*c* and second side wall 30*d*. Top wall 30*a* may define a recessed region 30*j* therein with a first angled surface 30*k* and a second angled surface 30*m* being provided at opposed ends of the recessed region 30*j*. A hole 30*n* may be defined partially in top wall 30*a* and partially in an upper surface of recessed region 30*j* of top wall 30*a*. Hole 30*n*, as shown in FIG. 18, may extend all the way through an enlarged U-shaped projection 30*n*" formed on first housing section 30, through to a shoulder 30*p* that is spaced a distance upwardly from bottom wall 30*b*. Vertically oriented slots 35 (FIGS. 6 and 7) are formed on either side of the U-shaped projection 30*n*" and these slots 35 open into the recessed region 30*j* and extend downwardly on either side of projection 30*n*" and are oriented generally parallel to hole 30*n*.

From shoulder 30*p* to an opening in bottom wall 30*b*, first hole 30*n* may narrow in diameter, thereby becoming hole 30*n*' that is accessible through an opening in bottom wall 30*b*.

A second projection 30*s*' is formed on first housing section 30 and extends for a distance further outwardly and forwardly away from end wall 30*e* than does projection 30*n*". A ledge 30*r* is located on an upper surface of projection 30*s*' a distance downwardly from recessed region 30*j*. An aperture 30*s* may be defined through projection 30*s*'; with aperture 30*s* originating in ledge 30*r* and extending downwardly for a distance, terminating a short distance below ledge 30*r*. Aperture 30*s* may be oriented substantially parallel to hole 30*n*.

Bottom wall 30*b* of first housing section 30 may define a depression 30*t* therein. Depression 30*t* may be substantially U-shaped when viewed from the front and may be configured to receive a portion of the U-shaped projection 14*c* of track 14 therein (as may be seen in FIG. 2).

First housing section 30 is also molded to define a solenoid support chamber 30*u* and a channel 30*u*' that is in communication with solenoid support chamber 30*u*. Channel 30*u*' extends outwardly from chamber 30*u* and towards projection 30*n*" and second projection 30*s*'. First housing section 30 also defines a groove 30*v* that is in communication with chamber 30*u* and extends downwardly therefrom and terminates in an opening in depression 30*t*.

First housing section 30 also defines a barrel lock chamber 30*w*. A projection 30*x* extends outwardly from barrel lock chamber 30*w* and a notch 30*y* is defined in projection 30*x*. A C-shaped opening 30*z* is defined in first side wall 30*c* of first housing section 30 and is in communication with barrel lock chamber 30*w*. Opening 30*z* provides part of an entrance into barrel lock chamber 30*w*.

Figure 7:
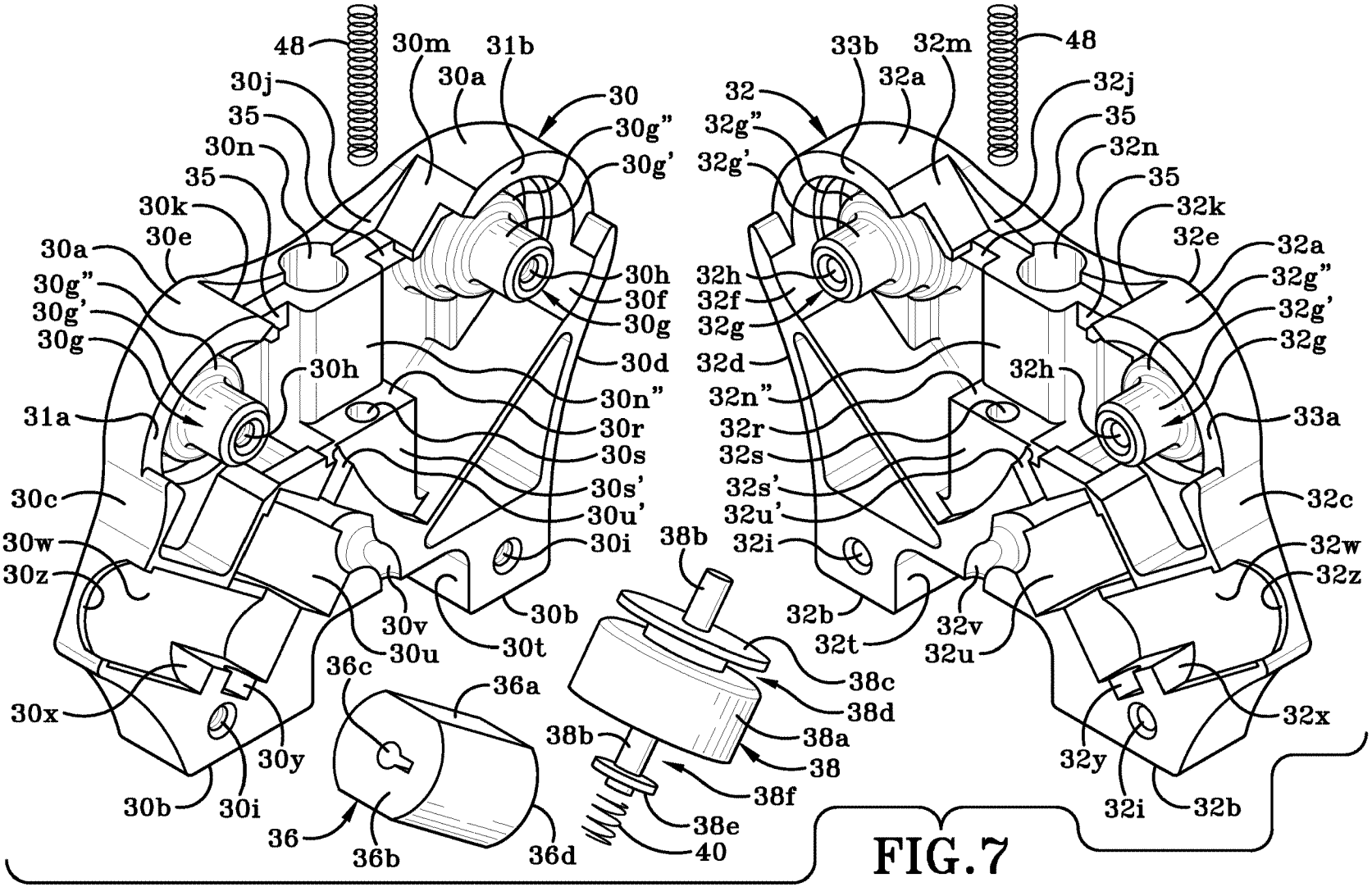
FIG. 7 is an exploded perspective view of the housing of the gun mounting lock with some components omitted for clarity.

FIG. 7 also shows that a first notch 31*a* is defined partially in top wall 30*a* and first side wall 30*c* of first housing section 30; and that a second notch 31*b* is defined partially in top wall 30*a* and second side wall 30*d* of first housing section 30.

Second housing section 32 may comprise a top wall 32*a*, a bottom wall 32*b*, a first side wall 32*c*, a second side wall 32*d*, and an end wall 32*e*. The walls 32*a*-32*e* bound and define a cavity 32*f*. A pair of hubs 32*g* extends outwardly from an interior surface of end wall 32*e*, a short distance downwardly from top wall 32*a*. A first one of the hubs 32*g* is located proximate first side wall 32*c* and the second one of the hubs 32*g* is located proximate second side wall 32*d*. Hubs 32*g* may be oriented generally at right angles to the interior surface of end wall 32*e*. Each hub 32*g* comprises a first hub section 32*g*' that is of a first diameter and a second hub section 32*g*" that is of a second diameter, where the second diameter is greater than the first diameter. First hub 32*g* also defines an aperture 32*h* therein that may be unthreaded and extends for a distance inwardly into one or both of the first hub section 32*g*' and 32*g*".

A first aperture 32*i* and a second aperture 32*i* may defined in end wall 32*e* proximate bottom wall 32*b*; each of the apertures 32*i* may be located proximate one or the other of first side wall 32*c* and second side wall 32*d*. Top wall 32*a* may define a recessed region 32*j* therein with a first angled surface 32*k* and a second angled surface 32*m* being provided at opposed ends of the recessed region 32*j*. A hole 32*n* may be defined partially in top wall 32*a* and partially in an upper surface of recessed region 32*j* of top wall 32*a*. Hole 32*n*, as shown in FIG. 18, may extend all the way through an enlarged U-shaped projection 32*n*" formed on second housing section 32, through to a shoulder 32*p* that is spaced a distance upwardly from bottom wall 32*b*. Vertically oriented slots 35 (FIGS. 6 and 7) are formed on either side of the U-shaped projection 32*n*" and these slots 35 open into the recessed region 32*j* and extend downwardly on either side of projection 32*n*" and are oriented generally parallel to hole 32*n*.

From shoulder 32*p* to an opening in bottom wall 32*b*, first hole 32*n* may narrow in diameter, thereby becoming hole 32*n*' that is accessible through an opening in bottom wall 32*b*.

A second projection 32*s*' is formed on second housing section 32 and extends for a distance further outwardly and forwardly away from end wall 32*e* than does projection 32*n*". A ledge 32*r* is located on an upper surface of projection 32*s*' a distance downwardly from recessed region 32*j*. An aperture 32*s* may be defined through projection 32*s*'; with aperture 32*s* originating in ledge 32*r* and extending downwardly for a distance, terminating a short distance below ledge 32*r*. Aperture 32*s* may be oriented substantially parallel to hole 32*n*.

Bottom wall 32*b* of second housing section 32 may define a depression 32*t* therein. Depression 32*t* may be substantially U-shaped when viewed from the front and may be configured to receive a portion of the U-shaped projection 14*c* of track 14 therein (as may be seen in FIG. 2).

Second housing section 32 is also molded to define a solenoid support chamber 32*u* and a channel 32*u*' that is in communication with solenoid support chamber 32*u*. Channel 32*u*' extends outwardly from chamber 32*u* and towards projection 32*n*" and second projection 32*s*'. Second housing section 32 also defines a groove 32*v* that is in communication with chamber 32*u* and extends downwardly therefrom and terminates in an opening in depression 32*t*.

Second housing section 32 also defines a barrel lock chamber 32*w*. A projection 32*x* extends outwardly from barrel lock chamber 32*w* and a notch 32*y* is defined in projection 32*x*. A C-shaped opening 32*z* is defined in first side wall 32*c* of second housing section 32 and is in communication with barrel lock chamber 32*w*. Opening 32*z* provides part of an entrance into barrel lock chamber 32*w*.

FIG. 7 also shows that a first notch 31*a* is defined partially in top wall 32*a* and first side wall 32*c* of second housing section 32; and that a second notch 31*b* is defined partially in top wall 32*a* and second side wall 32*d* of second housing section 32.

When first and second housing sections 30, 32 are engaged with each other, hubs 30*g* are aligned with hubs 32*g*, holes 30*h* are aligned with holes 32*h*; and holes 30*i* are aligned with holes 32*i*. Fasteners 34 (FIG. 2) are inserted through aligned holes 32*h* and 32*i* and are screwed into engagement with the threads of holes 30*h* and 30*i*. Furthermore, when first and second housing sections 30, 32 are engaged, the cavities 30*f*, 32*f* defined by the respective housing sections 30, 32 form the interior space of housing 18 within which various other components are received. The C-shaped sections 30*z*, 32*z* form an opening in a first side of housing 18; notches 31*a*, 33*a* form a first slot in the first side of housing 18; while notches 31*b*, 33*b* form a second slot in a second side of housing 18.

Figure 20:
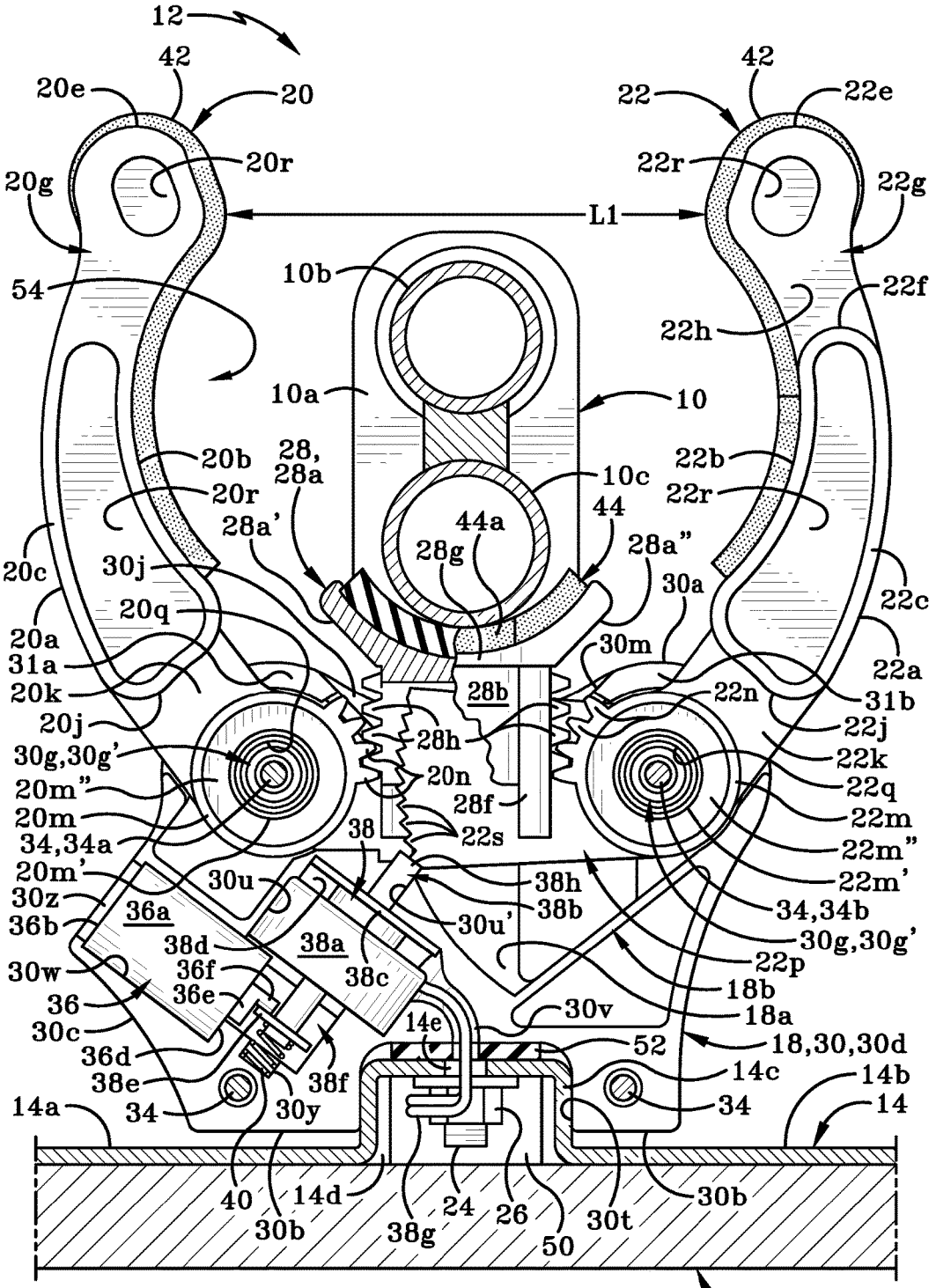
FIG. 20 is a front elevation view of the gun mounting lock in the open position with the second housing section removed and with the ratchet assembly partially broken away, and showing a gun barrel supported on the ratchet assembly.

FIGS. 7, 18 and 20 show that a barrel lock 36 and a solenoid 38 are received within the interior space defined by housing 18. Barrel lock 36 is seated in barrel lock chamber 30*w*, 32*w* and is provided are one mechanism for unlocking gun mounting lock 12. Solenoid 38 is seated in solenoid chamber 30*u*, 32*u* and is provided as another mechanism for unlocking gun mounting lock 12. (In other instances, barrel lock 36 and/or solenoid 38 may be provided as mechanisms for locking gun mounting lock 12 as will be described later herein.)

Barrel lock 36 may include a body 36*a* having a front face 36*b* that defines a keyhole slot 36*c* therein. (Barrel locks 36 are known in the art and therefore the specifics of the locking mechanism provided therein will not be further described herein.) Front face 36*b* of barrel lock 36 is accessible through the opening in the first side of the housing 18 defined by the two C-shaped recesses 30*z*, 32*z* that are defined in first side walls 30*c* and 32*c* of first and second housing sections 30, 32. Body 36*a* also includes a rear face 36*d* and a detent 36*e* extends outwardly for a distance from rear face 36*d*. Detent 36*e* includes a leg 36*f* that is oriented substantially at right angles to rear face 36*d* of body 36*a*. Detent 36*e* and therefore leg 36*f* are selectively rotatable when a key is inserted into slot 36*c* and is turned to unlock or lock the gun mounting lock 12.

Solenoid 38 may include a generally cylindrical body 38*a*, a pin 38*b* extending outwardly from each of the first and second end surfaces of body 38*a*; a first plate 38*c* that is located on pin 38*b* adjacent a first end surface of body 38*a* and is separated therefrom by a gap 38*d*; and a second plate 38*e* that is separated from the second end surface of body 38*a* by a space 38*f*. Pin 38*b* has an upper terminal end 38*h*. Body 38*a* is seated within solenoid support chamber 30*u*, 32*u*' while at least a first part of pin 38*b* is seated in channel 30*u*', 32*u*'. Channel 30*u*', 32*u*' supports pin 38*b* and provides a path for pin 38*b* to move along. Wiring 38*g* (FIGS. 1, 3 and 18 extends outwardly from body 38*a* and is fed through channel 30*v*, 32*v* and connects solenoid 38 to a power pack 50 that may be mounted in the cavity 14*d* defined of track 14. Power pack 50 may be provided with an actuator 50*a* (FIG. 1) that can be used to switch power to solenoid 38 on or off, as will be later described herein. It will be understood that actuator 50*a* may be provided on power pack 50 as shown in FIG. 1 or the actuator may be provided on housing 18. Actuator 50*a* may take any suitable form such as a button, a keypad, a fingerprint pad, a retinal scanner, a voice activator or any type of direct or remote activation means that enables a user to provide power to solenoid 38 or to cut power to solenoid 38.

A coil spring 40 surrounds a lower portion of pin 38*b* that extends outwardly from second plate 38*e*. Spring 40 and the lower portion of pin 38*b* are received in a depression (FIG. 20) defined partially by notch 30*y* in the interior surface of first housing section 30 and partially by notch 32*y* in the interior surface of second housing section 32. Spring 40 is provided to urge pin 38*b* upwardly in a direction away from bottom wall 30*b*, 32*b* of housing 18.

As indicated earlier herein, gun mounting lock 12 includes first arm 20 and second arm 22. These arms 20, 22 have first ends that are seated within the interior cavity of housing 18. The arms 20, 22 are mounted to housing 18 in a clam-shell type arrangement where they are opposed to each other and are able to pivot between an open position (shown in FIG. 2) and a closed position (shown in FIG. 21).

Figure 10:
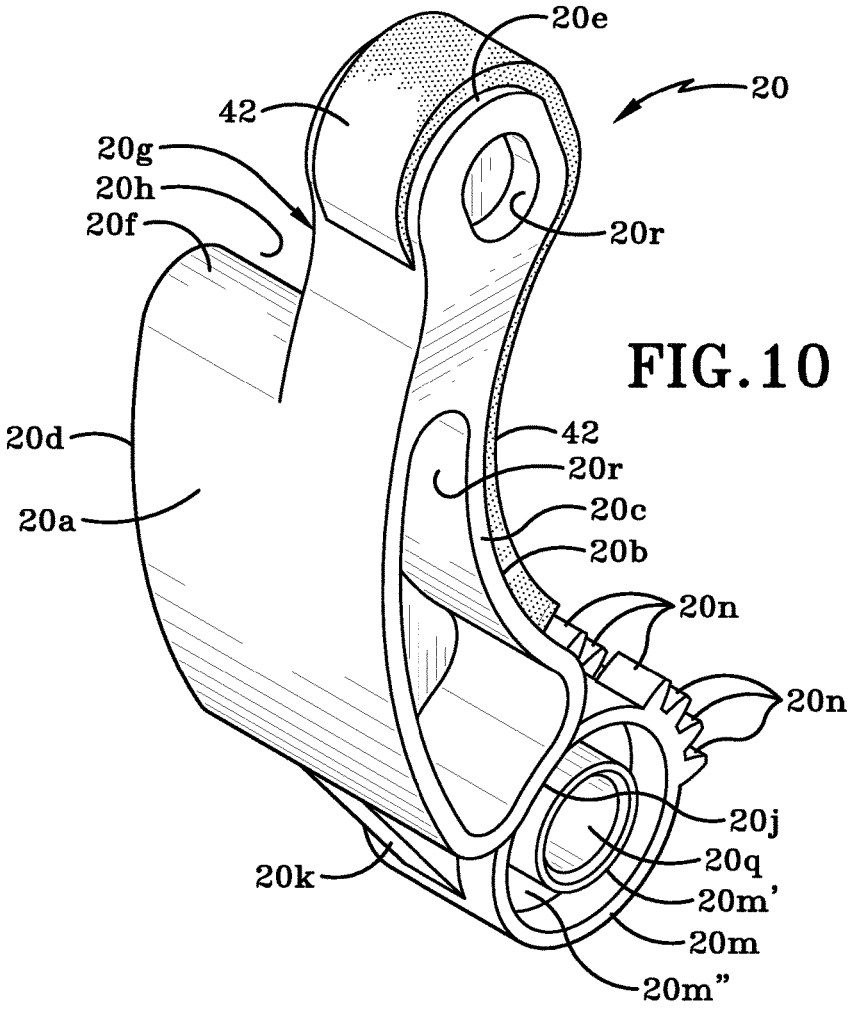
FIG. 10 is an enlarged isometric perspective view of the left locking arm of the gun mounting lock shown alone.
Figure 11:
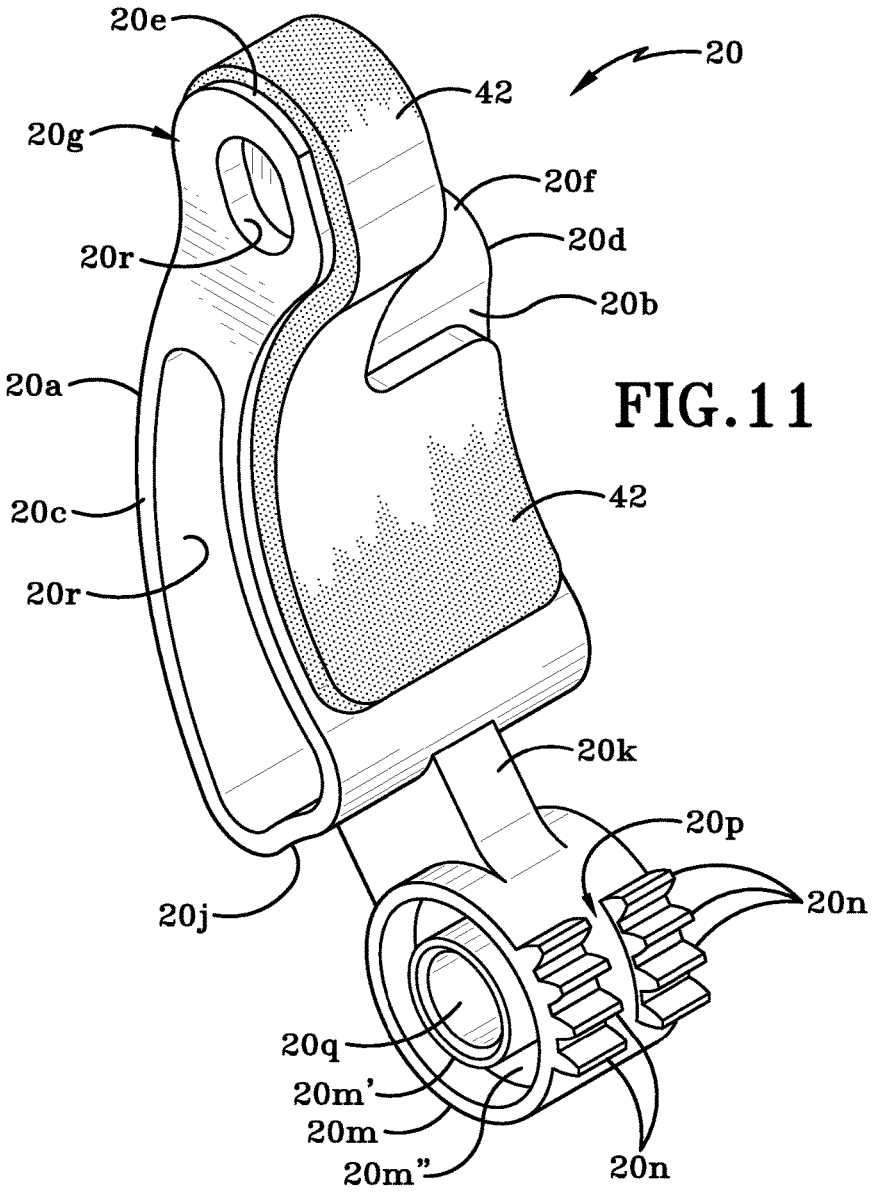
FIG. 11 is a perspective view of the left locking arm of FIG. 10 shown from a different angle.
Figure 12:
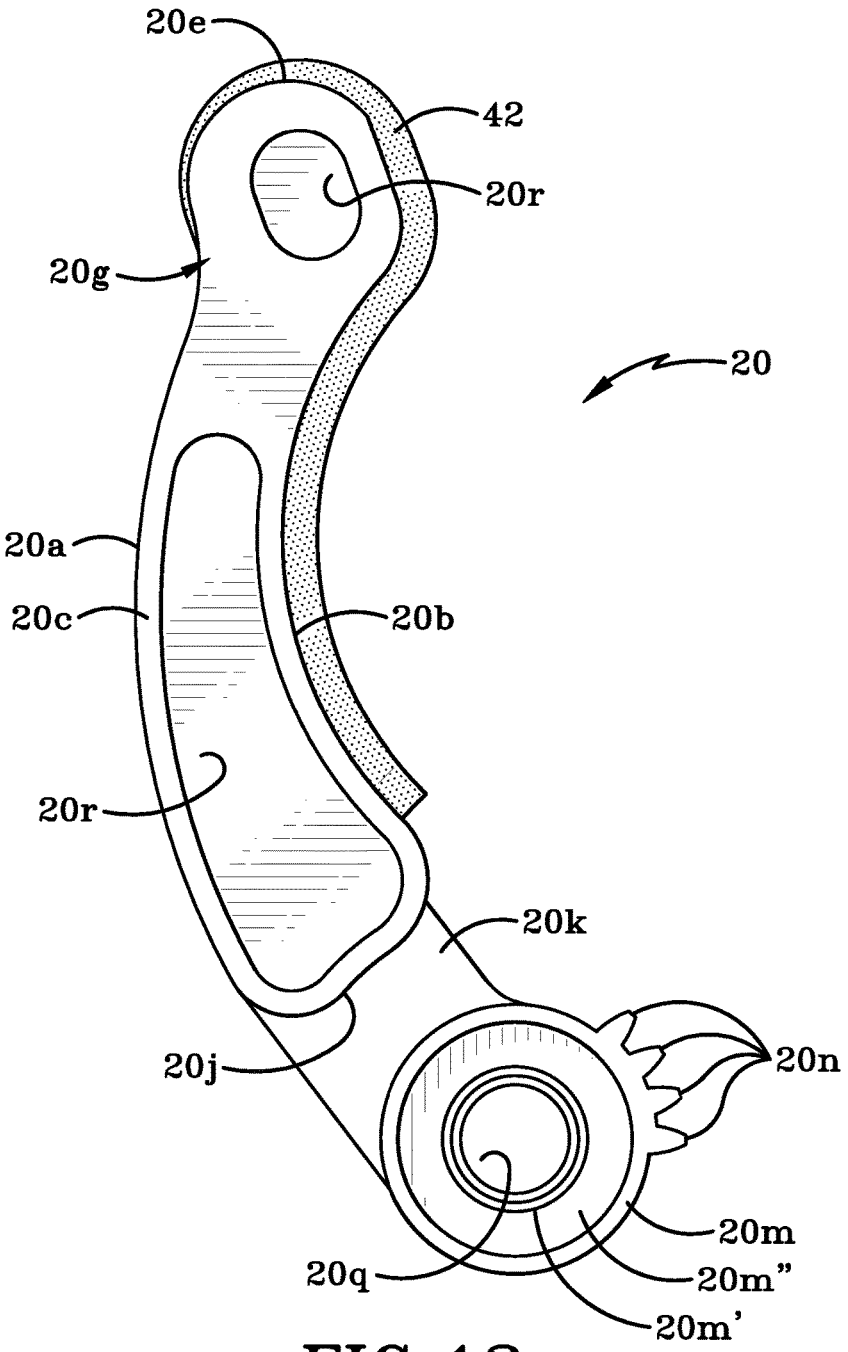
FIG. 12 is a front elevation view of the left locking arm of FIG. 10.
Figure 13:
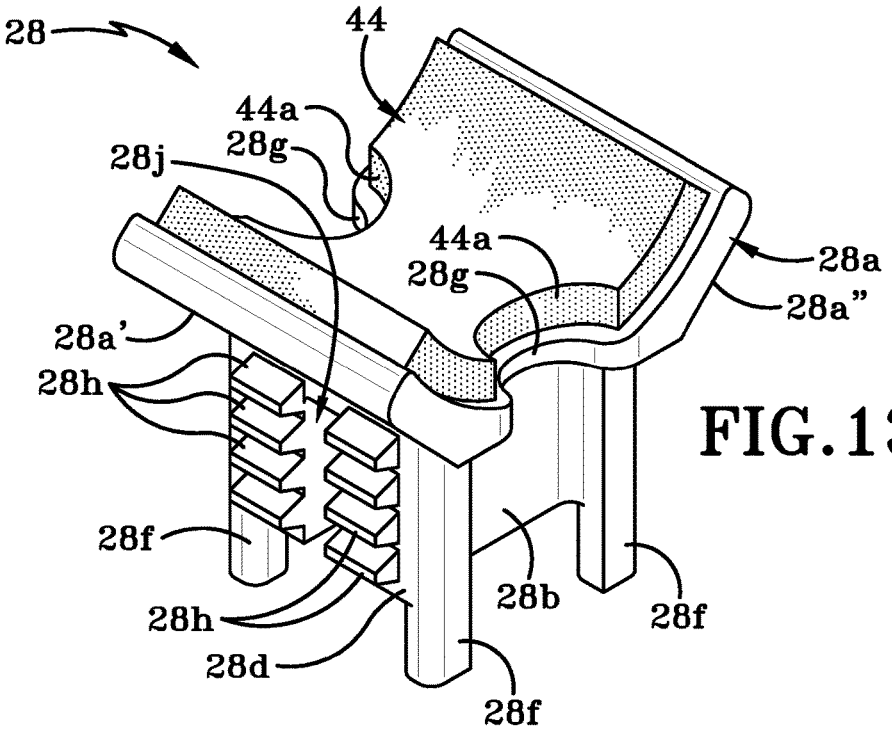
FIG. 13 is an enlarged front left isometric perspective view of the ratchet assembly shown alone.
Figure 14:
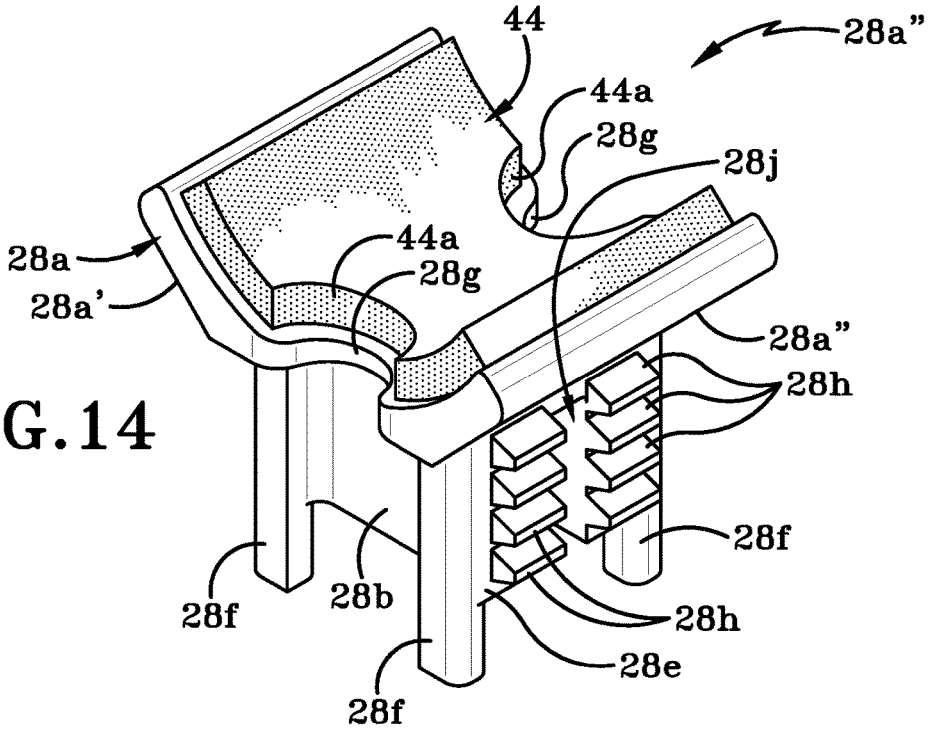
FIG. 14 is an enlarged front right isometric perspective view of the ratchet assembly of FIG. 13.
Figure 15:
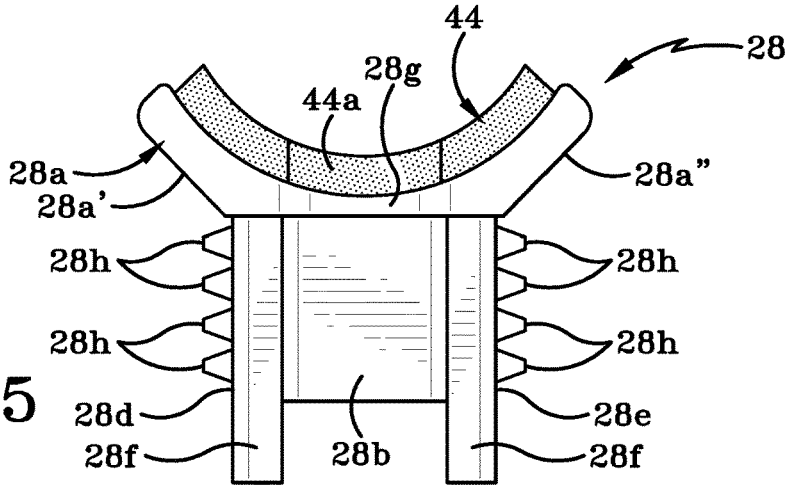
FIG. 15 is a front elevation view of the ratchet assembly of FIG. 13.

First arm 20 is shown by itself in FIGS. 10-12. First arm 20 comprises a body that is generally C-shaped (FIG. 12) when viewed from the front. First arm 20 has an exterior wall 20*a*, an interior wall 20*b*, a front end 20*c*, and a rear end 20*d*. First arm 20 also includes an upper end comprising a first upper wall 20*e* and a second upper wall 20*f*; where the second upper wall 20*f* is located a distance downwardly from first upper wall 20*e*. The effect of this is that the free end of first arm 20 forms a projection 20*g* that extends upwardly and outwardly for a distance beyond second upper wall 20*f*. A notch 20*h* is defined laterally adjacent projection 20*g*. It should be noted that notch 20*h* is located proximate rear end 20*d* and remote from front end 20*c*.

Figure 6:
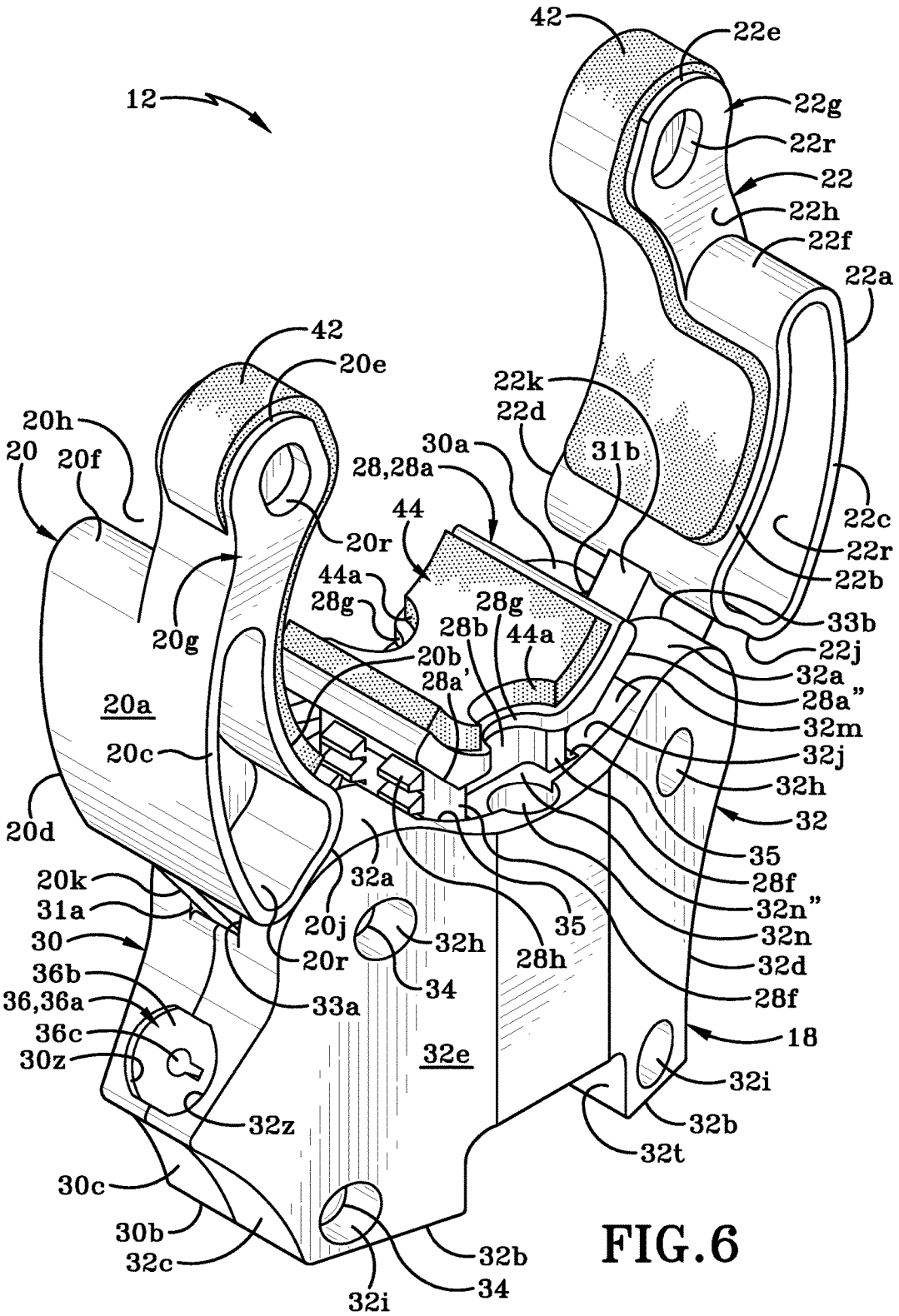
FIG. 6 is a left side isometric perspective view of the gun mounting lock shown in the open position.
Figure 19:
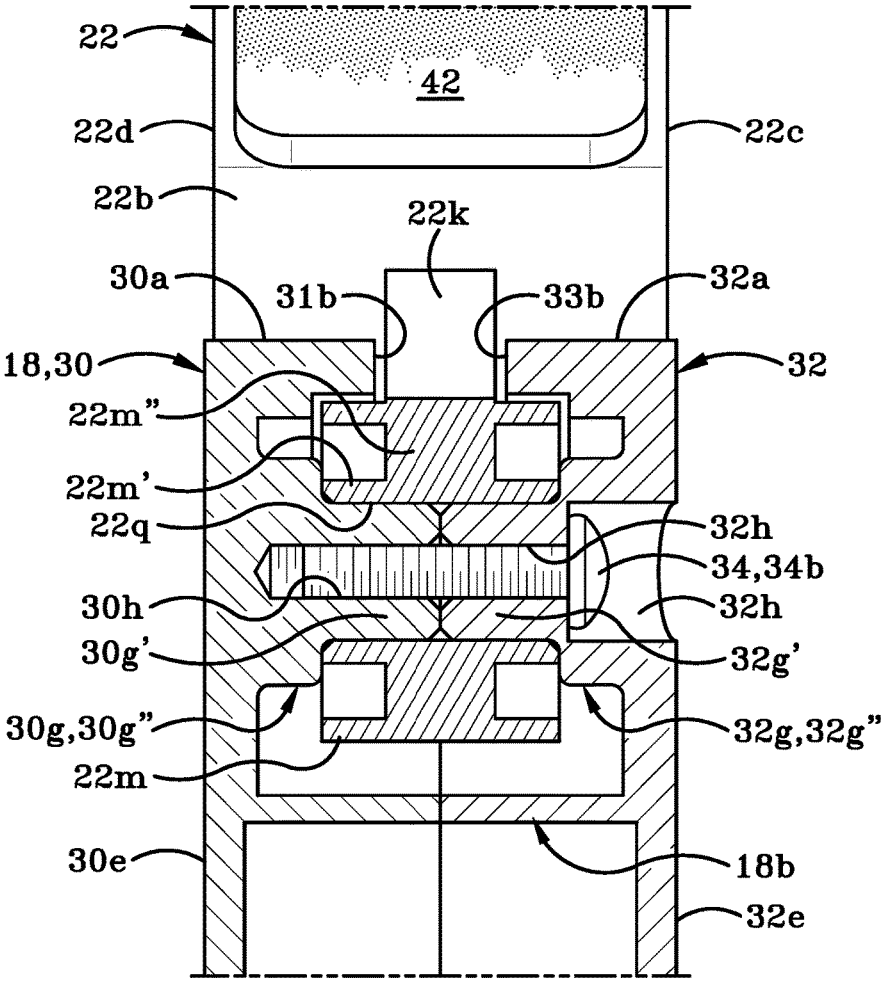
FIG. 19 is a partial cross-section of the right locking arm taken along line 19-19 of FIG. 2.
Figure 22:
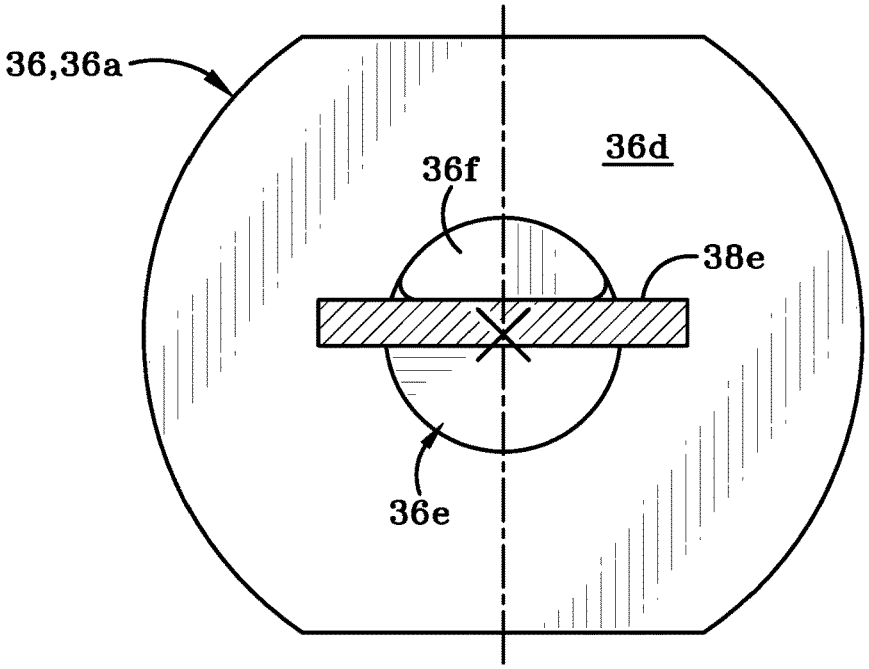
FIG. 22 is a rear view of a barrel lock taken along line 22-22 of FIG. 21.

First arm 20 has a lower end that includes lower wall 20*j* and may have a flange 20*k* which extends outwardly from lower wall 20*j*. A hub 20*m* may be provided at an end of flange 20*k*. Hub 20*m* may have a generally circular exterior wall upon which is provided at least one tooth 20*n*. Hub 20*m* may, instead have a row of teeth 20*n* or may have two or more rows of teeth 20*n*. If two or more rows are provided, then adjacent rows are spaced laterally apart from each other by a gap 20*p*. The rows of teeth 20*n* may be provided on that part of hub 20*m* that faces in the same general direction as interior wall 20*b*. A smaller diameter hub section 20*m*' may be located centrally within the exterior wall of hub 20*m* and be separated from the exterior wall by an annular ring 20*m*". The exterior wall of hub 20*m* and the hub section 20*m*' may be concentric. Hub section 20*m*' may define a through-hole 20*q* that extends from front end 20*c* through to rear end 20*d* of first arm 20. Hole 20*q* is sized to receive one of the hubs 30*g* of first housing section 30 and one of the hubs 30*h* of second housing section 32 therethrough, as is illustrated in FIGS. 19 and 22. The selected hubs 30*g* and 32*g* are positioned so that the apertures 30*h* and 32*h* therein are aligned with each other. A fastener 34 is inserted into hole 32*h* from an exterior surface of end wall 32*b* and into the threaded hole 30*h* in first housing section 30. Fastener 34 secures first and second housing sections 30, 32 together and also acts as part of a pivot rod around which first arm 20 may pivot. First arm 20 is configured to pivot about a longitudinal axis of the shaft of fastener 34. When first arm 20 is engaged within housing 18, flange 20*k* extends outwardly through the slot in housing 18 that is defined by notches 31*a* and 33*a*. This is shown in FIG. 6. The upper end of first arm 20 (including projection 20*g* is located outside of housing 18 and mounting hub 20*m* is located inside the interior cavity of housing 18.

First arm 20 may define one or more recesses 20*r* that may extend inwardly from front end 20*c* towards rear end 20*d* or from rear end 20*d* towards front end 20*c*, or all of the way from front end 20*c* through to rear end 20. Recesses 20*r* may be provided to reduce the overall weight of first arm 20. First arm 20 may also include a layer of padding 42 that may cover some or all of the surfaces on first arm 20 that may contact gun 10 when retained within gun mounting lock 20. As such, padding 42 may cover much or all of interior wall 20*b* including an interior surface of projection 20*g*. Padding 42 may extend upwardly over an uppermost end of first upper wall 20*e*. Padding 42 may terminate on an outer surface of projection 20*g* a distance above second upper wall 20*f*. Padding 42 may be secured to the various surfaces of first arm 20 using an adhesive or any other suitable type of fastener.

Figure 8:
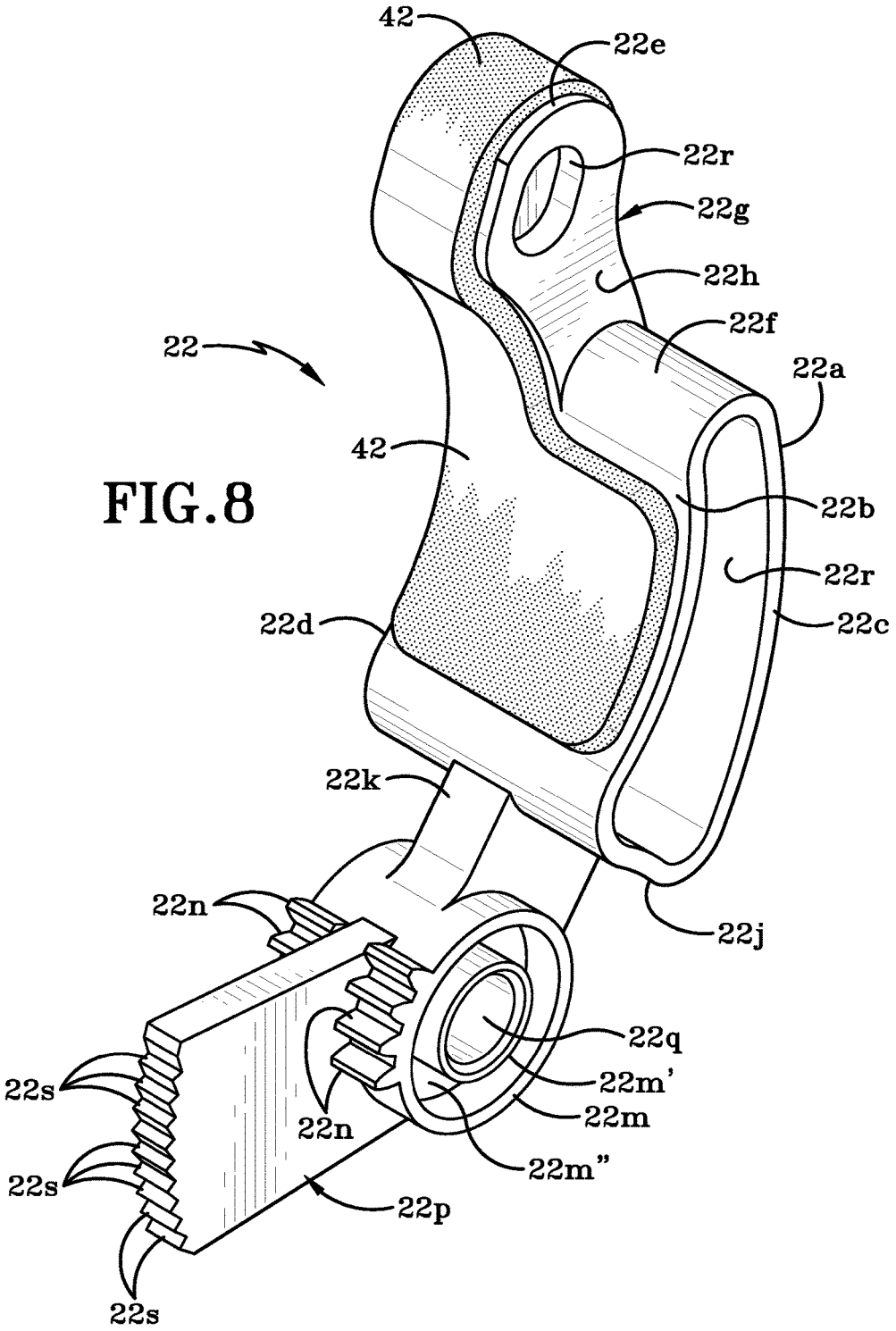
FIG. 8 is an enlarged perspective view of the right locking arm of the gun mounting lock shown alone.
Figure 9:
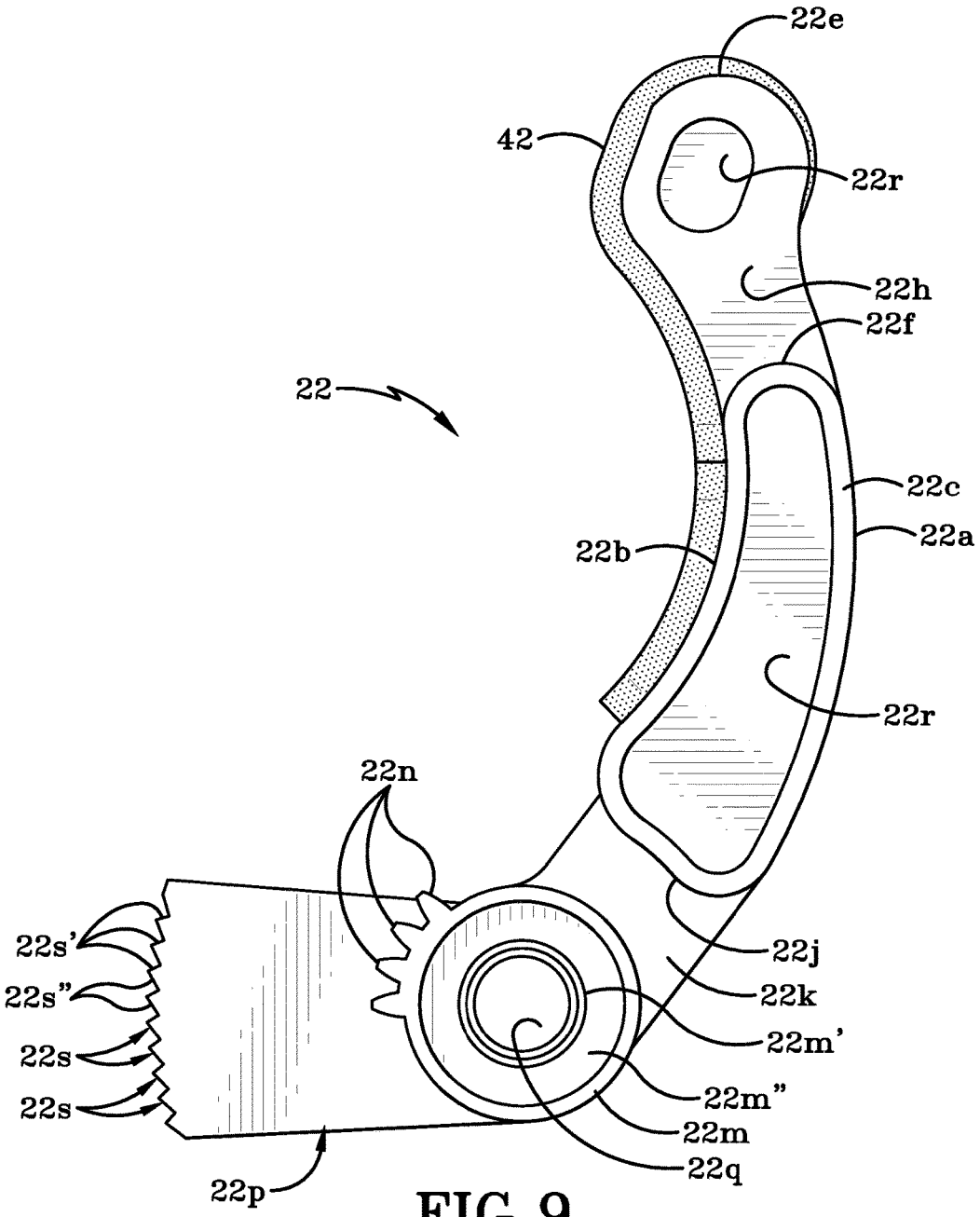
FIG. 9 is a front elevation view of the right locking arm of FIG. 8.

Second arm 22 is shown on its own in FIGS. 8-9. Second arm 22 may be substantially similar to first arm 20 and comprises a body that is generally C-shaped (FIG. 9) when viewed from the front. Second arm 22 has an exterior wall 22*a*, an interior wall 22*b*, a front end 22*c*, and a rear end 22*d* (FIG. 8). Second arm 22 also includes an upper end comprising a first upper wall 22*e* and a second upper wall 22*f*; where the second upper wall 22*f* is located a distance downwardly from first upper wall 22*e*. The effect of this is that a projection 22*g* extends upwardly and outwardly for a distance beyond second upper wall 22*f*; thereby defining a notch 22*h* laterally adjacent projection 22*g*.

Second arm 22 has a lower end that includes lower wall 22*j* and may have a flange 22*k* which extends outwardly from lower wall 22*j*. A hub 22*m* may be provided at an end of flange 22*k*. Hub 22*m* may have a generally circular exterior wall upon which is provided at least one tooth 22*n*. Hub 22*m* may, instead have a row of teeth 22*n* or may have two or more rows of teeth 22*n*. If two or more rows are provided, then adjacent rows are spaced laterally apart from each other by a gap 22*p*. The rows of teeth 22*n* may be provided on that part of hub 22*m* that faces in the same general direction as interior wall 22*b*. A smaller diameter hub section 22*m*' may be located centrally within the exterior wall of hub 22*m* and be separated from the exterior wall by an annular ring 22*m*". The exterior wall of hub 22*m* and the hub section 22*m*' may be concentric. Hub section 22*m*' may define a through-hole 22*q* that extends from front end 22*c* through to rear end 22*d* of second arm 22. Hole 22*q* is sized to receive a second one of the hubs 30*g* of first housing section 30 and a second one of the hubs 30*h* of second housing section 32 therethrough, as is illustrated in FIGS. 19 and 22. The selected second hubs 30*g* and 32*g* are positioned so that the apertures 30*h* and 32*h* therein are aligned with each other. A fastener 34 is inserted into hole 32*h* from an exterior surface of end wall 32*b* and into the threaded hole 30*h* in first housing section 30. Fastener 34 secures first and second housing sections 30, 32 together and also acts as part of a pivot rod around which second arm 22 may pivot. Second arm 22 is configured to pivot about a longitudinal axis of the shaft of fastener 34. When second arm 22 is engaged within housing 18, flange 22*k* extends outwardly through the slot in housing 18 that is defined by notches 31*b* and 33*b*. This is shown in FIG. 6. The upper end of second arm 22 (including projection 22*g* is located outside of housing 18 and mounting hub 22*m* is located inside the interior cavity of housing 18.

Second arm 22 may define one or more recesses 22*r* that may extend inwardly from front end 22*c* towards rear end 22*d* or from rear end 22*d* towards front end 22*c*, or all of the way from front end 22*c* through to rear end 22. Recesses 22*r* may be provided to reduce the overall weight of second arm 22. Second arm 22 may also include a layer of padding 42 that may cover some or all of the surfaces on second arm 22 that may contact gun 10 when retained within gun mounting lock 12. As such, padding 42 may cover much or all of interior wall 22*b* including an interior surface of projection 22*g*. Padding 42 may extend upwardly over an uppermost end of first upper wall 22*e*. Padding 42 may terminate on an outer surface of projection 22*g* a distance above second upper wall 22*f*. Padding 42 may be secured to the various surfaces of second arm 22 using an adhesive or any other suitable type of fastener.

Second arm 22 differs from first arm 20 in that a second flange 22*p* may extend outwardly from the exterior surface of hub 22*m* for a distance. Second flange 22*p* may extend from an area located between two adjacent rows of teeth 22*n*. A third row of teeth 22*s* may be provided on an end surface of second flange 22*p*. The rows of teeth 22*n* and 22*s* are provided on that part of hub 22*m* and second flange 22*p* that face in the same general direction as interior wall 22*b*. As is evident from FIGS. 8 and 11, second arm 22 differs from first arm 20 by the provision of second flange 22*p* between the rows of teeth 22*n* instead of gap 20*p* that is present between the rows of teeth 20*n*.

Figure 5:
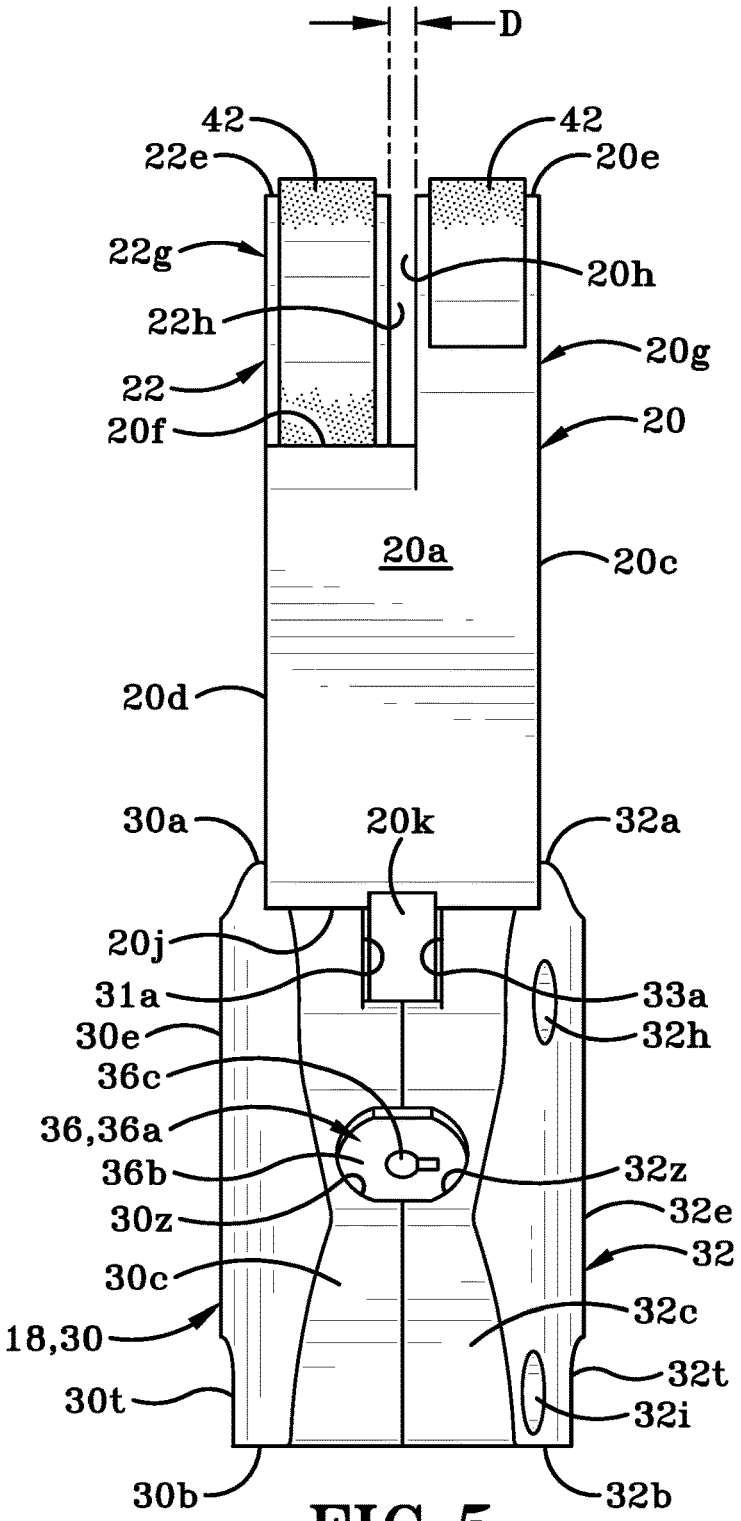
FIG. 5 is an enlarged left side elevation view of the gun mounting lock shown in the open position.

First arm 20 and second arm 22 also differ from each other in the location of the projections 20*g*, 22*g* and the notches 20*h*, 22*h*. While first and second arms 20, 22 are opposed to each other, the projections 20*g*, 22*g* provided thereon and the notches 20*h*, 20*g* defined thereby are offset relative to each other. This can be seen in FIG. 5. FIG. 5 also shows that a rear surface of projection 20*g* is spaced a distance "D" away from a front surface of projection 22*g*. Projection 20*g* on first arm 20 is aligned with notch 22*h* on second arm 22 and the projection 22*g* on second arm 22 is aligned with notch 20*h* on first arm 20. When the first and second arms 20, 22 are moved to a closed position (FIG. 21) projection 20*g* is received in notch 22*h* and projection 22*g* is received in notch 20*h*. The two arms 20, 22 therefore are able to close like a clam-shell and the projections 20*g*, 22*g* and notches 20*h*, 22*h* dovetail into engagement with each other.

As shown in FIG. 2, when first and second arms 20, 22 are in the open position (i.e., when gun mounting lock 12 is in an unlocked position and is ready to receive a gun 10 therein) the first and second arms 20, 22 form a generally U-shape and bound and define a generally U-shaped opening 54 between their interior surfaces 20*b* and 22*b*. The distance between the interior surfaces 20*b*, 22*b* is indicated as the distance "L1". It should also be noted that the curvature of first arm 20 is mirrored by the curvature of second arm 22, i.e., the two interior surfaces 20*b* and 22*b* curve in opposite directions from each other.

Figure 21:
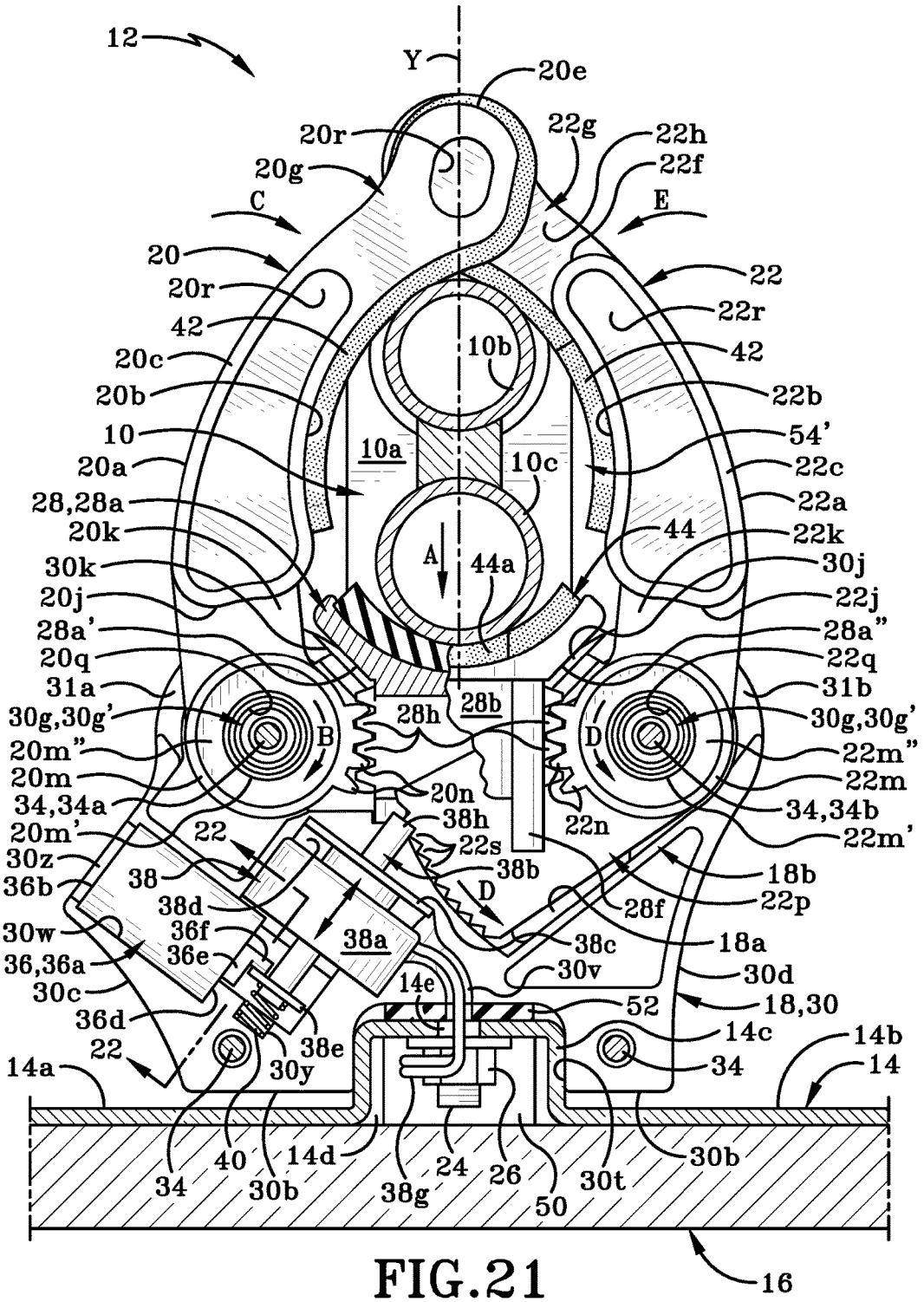
FIG. 21 is a front elevation view of the gun mounting lock in the closed position with the second housing section removed and with the ratchet assembly partially broken away and showing a gun barrel supported on the ratchet assembly and secured in place by the first and second arms.
Figure 23:
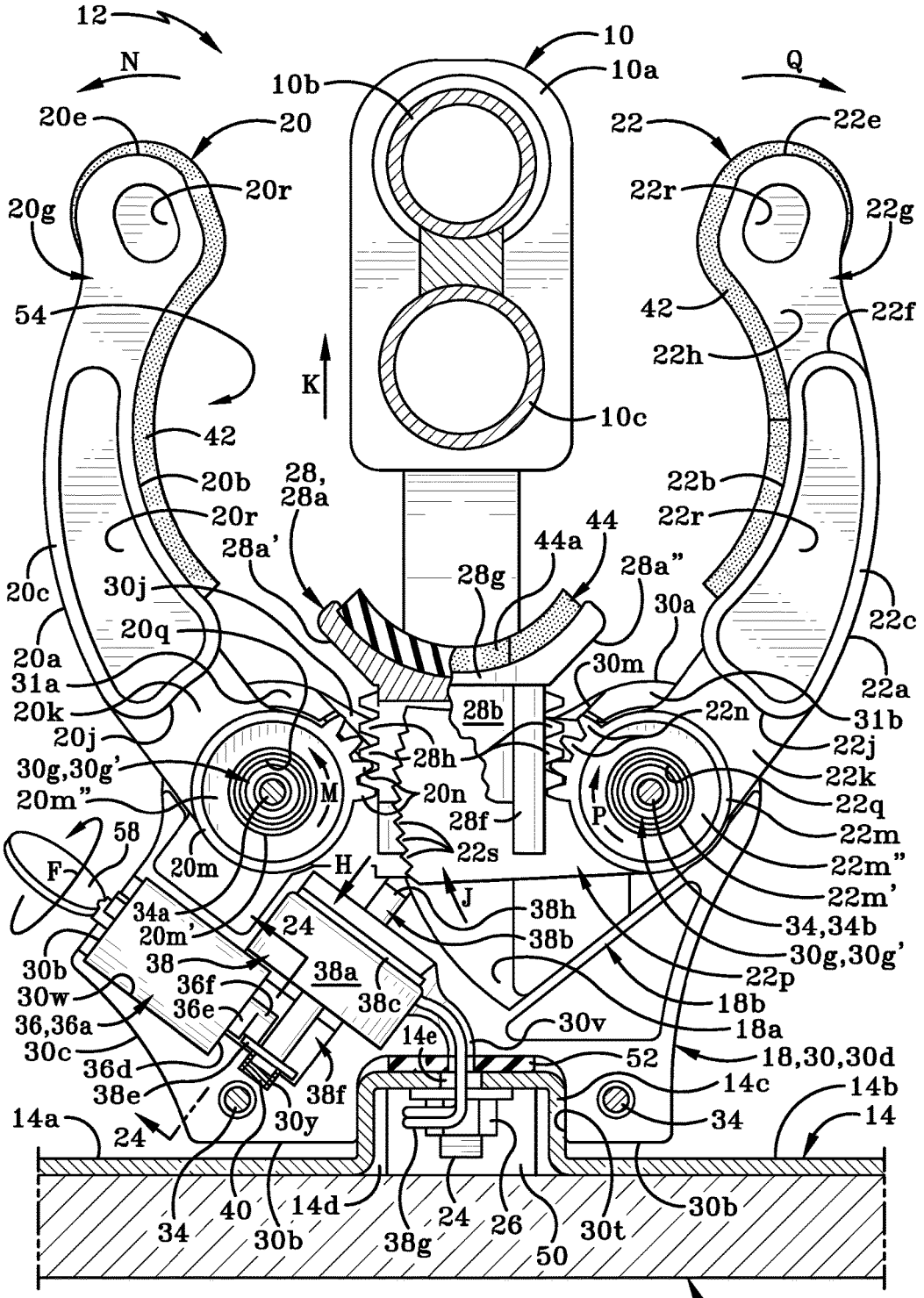
FIG. 23 is a front elevation

When first and second arms 20, 22 are moved to the closed position (i.e., when a gun 10 is captured within the space defined between the arms 20, 22 as is shown in FIG. 23), the projections 20*g* and 22*g* are brought into alignment one behind the other along the same axis when gun mounting lock is viewed from the front. Additionally, the shape of the opening 54 defined between the interior surfaces 20*b*, 22*b* is changed from a generally U-shaped opening 54 to a generally elliptically-shaped opening 54' (FIG. 21). The distance between interior surface 20*b* and interior surface 22*b* is reduced to a distance "L2". Additionally, since the projections 20*g*, 22*g* overlap each other, access to opening 54' from a direction between the two upper ends 20*e*, 22*e* is blocked off. The method of pivoting first and second arms 20, 22 between the open position (FIG. 2) and the closed position (FIG. 21) will be further described herein.

Referring primarily to FIGS. 13-18, ratchet assembly 28 is shown in greater detail. Ratchet assembly 28 is shaped and sized to be received in an opening 18*c* defined in top wall 30*a*, 30*b* of housing 18. Opening 18*c* is in communication with the interior cavity of housing 18. Ratchet assembly 28 is located between first arm 20 and second arm 22 and ratchet assembly 28, first arm 20 and second arm 22 are located generally along the same axis "X" as is shown in FIG. 3. Ratchet assembly 28 is designed to move linearly up and down relative to the top wall 30*a*, 30*b* of housing 18. In other words, ratchet assembly 28 is configured to move along a vertical axis "Y" (FIG. 18) that is oriented at right angles to the axis "X". First arm 20 and second arm 22 are configured to pivot between a closed position where the projections 20*g*, 22*g* thereof are generally aligned along vertical axis "Y" with ratchet assembly 28; and an open position where the projections 20*g*, 22*g* are not aligned with ratchet assembly along axis "Y" and are instead located a distance laterally from ratchet assembly 28 and on either side of the axis "Y".

Ratchet assembly 28 comprises a base having a top wall 28*a*, a first side wall 28*b*, a second side wall 28*c*, a first end wall 28*d*, and a fourth end wall 28*e*. The side walls 28*b*, 28*c* meet the end walls 28*d*, 28*e* at corner posts, all of which are indicated by reference character 28*f*. First and second side walls 28*b*, 28*c* and first and second end walls 28*d*, 28*e* are recessed relative to posts 28*f*. Top wall 28*a* extends for a distance beyond each of the first side wall 28*b*, second side wall 28*c*, first end wall 28*d* and second end wall 28*e*, and beyond all corner posts 28*f*. Top wall 28*a* is concavely curved when viewed from the side (see FIG. 15). The curved shape enables top wall 28*a* to cradle part of a gun barrel 10*b* thereon. The lower surface of top wall 28*a* defines two opposed angled surfaces 28*a*' and 28*a*". The surfaces 28*a*' and 28*a*" are shaped and sized to be complementary to angled surfaces 30*k*/32*k* and 30*m*/32*m*, respectively. When ratchet assembly 28 is moved downwardly in a first direction relative to an upper wall of housing 18 and into the depression 30*j*, 32*j*, then the angled surface 28*a*' abuts surfaces 30*k*/32*k*; and angled surface 28*a*" abuts surfaces 30*m*/32*m*. Top wall 28*a* defines a pair of notches 28*g* in locations proximate first and second side walls 28*b*, 28*c*. Padding 44 is applied to an uppermost surface of top wall 28*a* and the padding 44 also defines a pair of notches 44*a* therein that are substantially aligned with notches 28*g*. When a gun barrel 10*b* is placed on ratchet assembly 28, the barrel 10*b* will contact padding 44 and be cradled by top wall 28*a*. (It will be understood that padding 44 may be omitted if desired.)

Each of the first and second side walls 28*b*, 28*c* may be substantially smooth along their entire length, width and height. When ratchet assembly 28 is engaged in housing 18, the projections 30*n*' and 32*n*' are received within one or the other of the recessed regions defined by first side wall 28*b* and the posts 28*f* at either end thereof; and second side wall 28*c* and the posts 28*f* at either end thereof.

Figure 16:
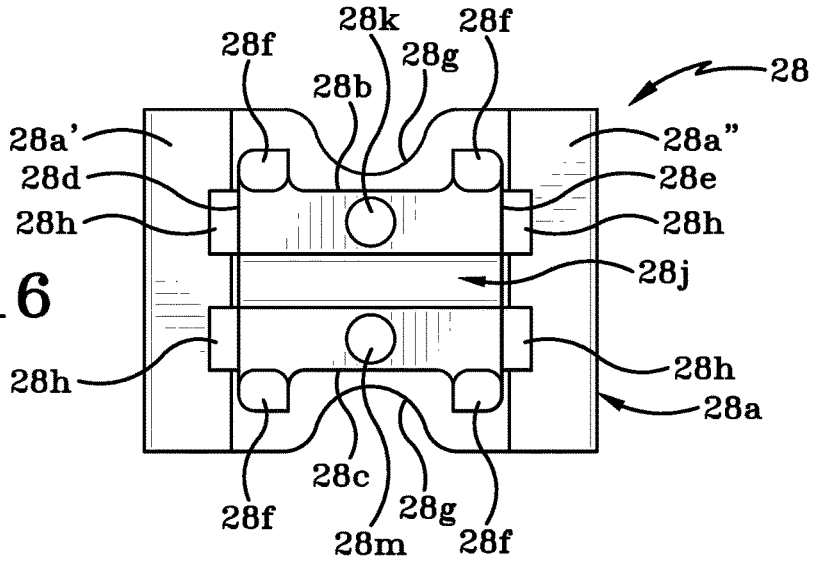
FIG. 16 is a bottom plan view of the ratchet assembly of FIG. 13.
Figure 17:
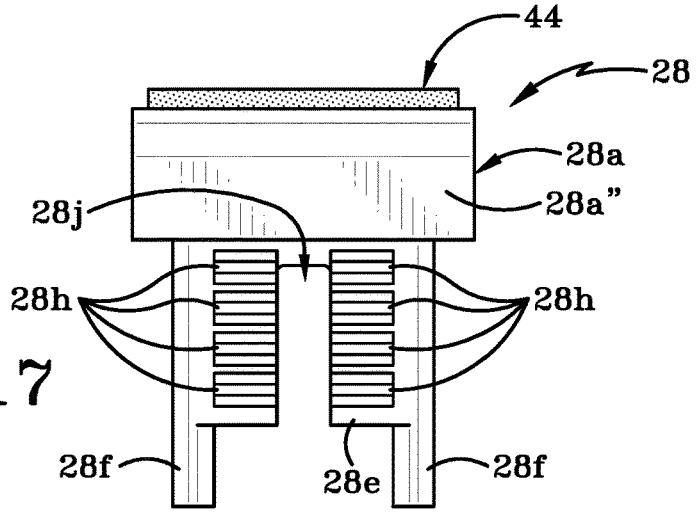
FIG. 17 is a right side elevation view of the ratchet assembly of FIG. 13.

Each of the first and second end walls 28*d*, 28*e* may include at least one tooth 28*h* that extends outwardly therefrom. First and second end walls 28*d*, 28*e* may include a row of teeth 28*h* or two or more spaced apart rows of teeth 28. The rows of teeth 28*h* may be oriented generally at right angles to top wall 28*a*. One or both of the first and second end walls 28*d*, 28*e* may define a slot 28*j* therein that is oriented generally at right angles to top wall 28*a* (FIGS. 16 and 17). At least the one of first and second end walls 28*d*, 28*e* that is proximate a lower end of second arm 22 defines slot 28*j* therein. If two rows of teeth 28*h* are provided on ratchet assembly 28, then the rows of teeth 28*h* may flank slot 28*j*. Slot 28*j* is sized and shaped to receive second flange 22*p* of second arm 22 therein. Second flange 22*p* is located so that when second arm 22 pivots in either of a first direction towards first arm 20 or in a second direction away from second arm 22, second flange 22*p* will move downwardly or upwardly through slot 28*j* and into or out of a space 18*a* defined between projections 30*s*' and 32*s*' on housing 18. This space 18*a* may be seen in FIG. 18. Second flange 22*p* may therefore move through an arc toward or away from the wall 18*b* (FIG. 20) during operation of gun mounting lock 12.

FIGS. 16 and 18 show that the base of ratchet assembly 28 defines a pair of apertures 28*k*, 28*m* therein, wherein each aperture 28*k*, 28*m* is located inwardly from one or the other first side surface 28*b* or second side surface 28*c*. When ratchet assembly 28 is engaged in opening 18*c* of housing 18, aperture 28*k* is vertically aligned with aperture 30*s* in first housing section 30 and aperture 28*m* is vertically aligned with aperture 32*s* in second housing section 32. A set screw 46 and spring 48 are received in each pair of aligned apertures 28*k*/30*s* and 28*k*/32*s*. Each set screw 46 is provided to adjust the tension in the associate spring 48. Springs 48 control the rate at which ratchet assembly 28 may be pushed downwardly when a gun 10 is engaged with gun mounting lock 12, as will be described hereafter. Springs 48 also urge ratchet assembly 28 upwardly and therefore assist in returning the ratchet assembly 28 to its initial position (FIG. 2) when gun 10 is removed from gun mounting lock 12.

Referring to FIGS. 18-24, gun mounting lock 12 is operated in the following manner. Padding 52 may positioned in U-shaped channel 30*t*/32*t* and then housing 18 is engageable with track 14 by interlocking channel 30*t*/32*t* on projection 14*c* of track 14. Padding 52 may be made of any suitable type of resilient material such as rubber or foam. In particular, padding 52 may be positioned between an uppermost surface of projection 14*c* of track 14 and the interior surface of U-shaped channel 30*t*, 32*t* formed by housing 18. If provided, padding 52 defines openings 52*a* therein that are aligned with each of the holes 30*n*' and 32*n*'. Mounting screws 24 inserted through holes 30*n*/30*n*' and 32*n*/32*n*' are through the associated openings 52*a* in padding 52 and into a selected slot 14*e* of track 14. Nuts 26 are engaged with mounting screws 24 and are finger tightened to keep housing 18 loosely engaged with track 14. Housing 18 is moved relative to track 14 by sliding mounting screws 24 along slot 14*e* until housing 14 is in a desired position. Nuts 26 are then fully tightened to lock housing 18 and track 14 together.

Wiring 38*g* extending outwardly from channel 30*v*/32*v* of housing 18 is threaded through slot 14*e* of track 14 either before or after securing housing 18 to track 14. Wiring 38*g* is connected to power pack 50 (FIG. 1) and power pack 50 is positioned within channel 14*d* of track 14. Power pack 50 is provided to supply current to solenoid 38. Track 14 is placed on support surface 16 and is secured to support surface 16 by any suitable means.

FIG. 20 shows housing 18 engaged with track 14 and track 14 positioned on support surface 16. FIG. 20 also shows gun mounting lock 12 in an open position with projection 20*g* of first arm 20 and projection 22*g* of second arm 22 spaced a distance "L1" away from each other and a U-shaped space 54 defined between first and second arms 20, 22. Space 54 is accessible through an opening defined between projection 20*g* and projection 22*g*. FIG. 20 also shows gun mounting lock 12 in an unlocked position with second flange 22*p* of second arm 22 positioned in an at rest position and located a distance away from surface 18*b* on first housing section 30, 32. Spring 40 is in an uncompressed state and is urging pin 38*b* of solenoid 38 into contact with a lower region of teeth 22*s* on second flange 22*p*. Pin 38*b* of solenoid 38 is positioned so that second plate 38*d* is adjacent leg 36*f* of barrel lock 36 as shown in FIG. 22. FIG. 20 also shows a lower barrel 10*c* of a gun 10 cradled on padding 44 of ratchet assembly 28 but no downward force being applied to ratchet assembly 28.

In order to move gun mounting lock 12 from the open and unlocked position (FIG. 20) to the closed and locked position (FIG. 21), a downward force is applied to barrels 10*b*, 10*c* of gun 10 in the direction indicated by arrow "A" (FIG. 21). Movement of the gun 10 in the direction "A" causes gun 10 to apply a force to ratchet assembly 28 in the direction of arrow "A" and ratchet assembly 28 moves downwardly within opening 18*c* of housing 18. It should be noted that as ratchet assembly 28 moves downwardly in the direction of arrow "A", springs 48 (FIG. 18) become compressed between set screws 46 and the portion of housing 18 that defines depressions 30*s*, 32*s*.

As is shown in FIG. 21, teeth 28*h* on ratchet assembly 28 are interlockingly engaged with teeth 20*n* and 22*n* of first and second arms 20, 22. The downward movement of ratchet assembly 28 in the direction of arrow "A" causes teeth 28*h* to move teeth 20*n*, 22*n* downwardly and this in turn causes rotational motion of the hub 20*m* in the direction of arrow "B"; thereby pivoting first arm 20 in the direction of arrow "C" about an axis that extends along the shaft of fastener 34*a*. The motion of ratchet assembly 28 and thereby teeth 28*h* in the direction of arrow "A" also drives teeth 22*n* downwardly and causes rotation of hub 22*m* in the direction of arrow "D". Rotation of hub 22*m* pivots second arm 22 in the direction of arrow "E" about an axis that extends along the shaft of fastener 34*b*. It should be noted that the downward linear movement of ratchet assembly 28 in the direction of arrow "A" causes hubs 20*m* and 22*m* to rotate inwardly toward each other in the directions "B" and "C"; and thereby causes first and second arms 20, 22 to pivot inwardly towards each other in the direction "D" and "E". The rotation of hubs 20*m* and 22*m* in the direction "B" and "C" occurs substantially simultaneously. Additionally, the rotation of first and second arms 20, 22 occurs substantially simultaneously and the movement is synchronized.

The rotation of first arm 20 and second arm 22 causes the space 54 to be reduced in size to space 54' as projection 20*g* on first arm 20 is received into notch 22*h* and projection 22*g* on second arm 22 is received into notch 20*h*. As indicated earlier herein the pivotal motion occurs until projections 20*g* and 22*g* are aligned with each other over a generally central region of ratchet assembly 28. In this end position, the projections 20*g*, 22*g* of first and second arms 20, 22 are brought into contact with upper barrel 10*b* of gun, thus locking gun between projections 20*g*, 22*g* and padding 44 on ratchet assembly 28.

In addition to first and second arms 20, 22 moving into interlocking engagement with each other as described above, as mounting hub 22*m* rotates in the direction of arrow "D", second flange 22*p* is rotated in unison therewith in the direction indicated by arrow "D" (FIG. 21). The rotation of second flange 22*p* moves second flange 22*p* towards surface 18*b* and also causes teeth 22*s* on second flange 22*p* to slide downwardly past upper end 38*h* of pin 38*b* of solenoid 38. Teeth 22*s* each have an upper surface 22*s*' (FIG. 9) and a lower surface 22*s*" that meet at a tip. The upper and lower surfaces 22*s*', 22*s*" are differently angled. The lower surfaces 22*s*" are angled so that second flange 22*p* is able to rotate downwardly past upper end 38*h* of pin 38*b* of solenoid in the direction of arrow "D". Spring 40 is slightly compressed as pin 38*b* is pushed downwardly away from second flange 22*p* as upper end 38*h* slides along lower surface 22*s*" of each tooth 22*s*. When upper end 38*h* of pin 38*b* passes over the tip of any particular tooth then spring 40 will return to its original uncompressed position and upper end 38*h* will again begin to slide along the lower surface 22*s*" of the adjacent tooth. Rotation of second flange 22*p* in a direction opposite to arrow "D" is substantially prevented by pin 38*b* engaging the lower surface 22*s*". This is because the angle of the upper surface 22*s*' of each tooth is substantially complementary to the angle of the side surface of 38*b* and, consequently, shaft 38*b* prevents the teeth 22*s* from moving in the opposite direction. Spring 40 around pin 38*b* of solenoid 38 urges pin 38*b* towards second flange 22*p* and thereby aids in keeping pin 38*b* engaged with teeth 22*s*.

When rotation in the direction "D" ceases because first and second arms 20, 22 are interlocked with each other, then gun mounting lock 12 is in a locked position because shaft 38*b* substantially prevents rotation of second flange 28*p* in a direction opposite to direction "D". Since teeth 20*n* and 22*n* on mounting hubs 20*m*, 22*m* are interlocked with teeth 28*h* on ratchet assembly 28, first and second arms 20, 22 cannot pivot in the directions opposite to arrows "C" and "E" and ratchet assembly 28 cannot move upwardly in a direction opposite to arrow "A".

It should also be noted from FIG. 21 that first and second arms 20, 22 are in the closed position capturing gun barrels 10*b*, 10*c* between projections 20*g*, 22*g* and padding 44 when gun mounting lock 12 is in the locked position. Consequently, gun 10 cannot be disengaged from gun mounting lock 12. Gun mounting lock 12 will remain in the locked position until the user unlocks the gun mounting lock 12 as will be described hereafter.

Figure 24:
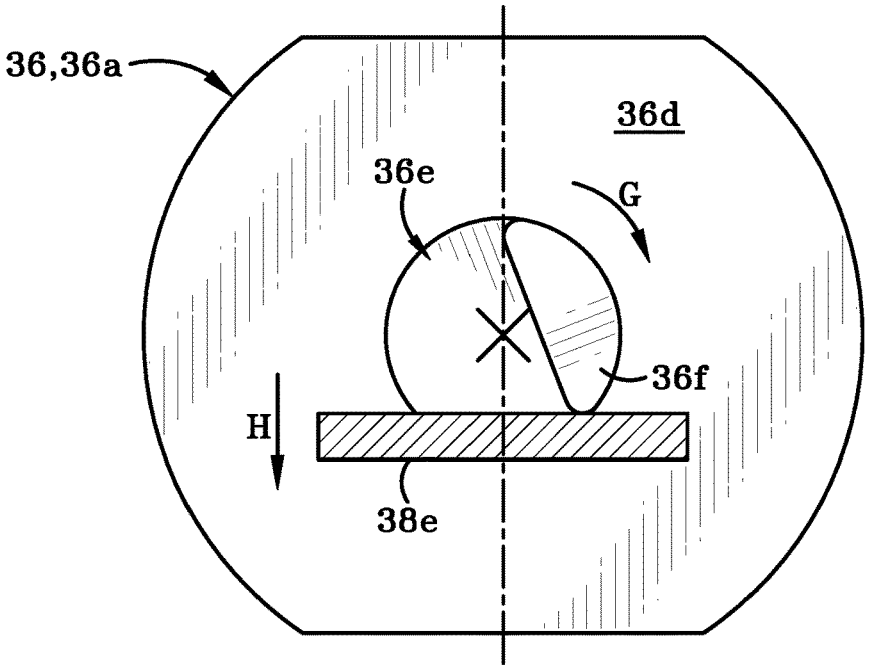
FIG. 24 is a rear view of the barrel lock taken along line 24-24 of FIG. 23.

If it is desired to remove gun 10 from gun mounting lock 12, the lock 12 must be unlocked and moved from the closed position shown in FIG. 21 to the open, unlocked position shown in FIG. 23. There are two possible ways to unlock gun mounting lock 12. In a first way, a key 58 (FIG. 23) is inserted into barrel lock 36 and is turned or rotated in the direction indicated by the arrow "F". Rotation of key 58 causes detent 36*e* and leg 36*f* to rotate in the direction "G" (FIG. 24). Rotation in the direction of arrow "G" causes leg 36*f* of barrel lock 36 to apply a downward force to the upper surface of second plate 38*e*. As a result, second plate 38*e* is moved downwardly in the direction of arrow "H" (FIGS. 24 and 23). The downward movement of second plate 38*e* causes a corresponding downward movement of pin 38*b* in the direction of arrow "H" (FIG. 23). The movement of pin 38*b* in the direction of arrow "H" withdraws pin 38*b* away from teeth 22*s* and breaks contact between pin 38*b* and teeth 22*s* of second flange 22*p*. Once contact is broken, second flange 22*p* is free to rotate upwardly in the direction indicated by arrow "J" (FIG. 23). Since second flange 22*p* is no longer locked against movement, ratchet assembly 28 (which is geared to mounting hub 22*m*) is free to move. Springs 48 (FIG. 18) return to their uncompressed state and as they do this ratchet assembly 28 is moved in the direction indicated by arrow "K" (FIG. 23). Since mounting hub 20*m* is geared to ratchet assembly 28, mounting hub 20*m* rotates in the direction of arrow "M" in response to the upward movement of ratchet assembly 28 in the direction of arrow "K". First arm 20 pivots in the direction indicated by arrow "N" in response to the rotation of mounting hub 20*m* in the direction "M". Simultaneously, since mounting hub 22*m* is geared to ratchet assembly 28, upward movement of ratchet assembly 28 in the direction of arrow "K" causes a rotational response in mounting hub 22*m* and hub 22*m* rotates in the direction "P". Rotation of mounting hub 22*m* in the direction "P" causes a pivotal response in second arm 22 and second arm 22 pivots in the direction indicated by arrow "Q". It should be noted that mounting hubs 20*m*, 22*m* rotate away from each other in the directions "M" and "P" and first and second arms 20, 22 pivot away from each other in the directions "N" and "Q". As first and second arms 20, 22 pivot away from each other the opening between the upper ends thereof again becomes accessible and gun 10 may be removed from within space 54.

The other method of unlocking gun mounting lock 12 involves providing power to solenoid 38. This can be done by a user engaging actuator 50*a*. As power is provided to solenoid 38, pin 38*b* is physically moved downwardly in the direction indicated by arrow "H" in FIG. 23. This motion withdraws upper end 38*h* of pin 38*b* from its contact with teeth 22*s* on second flange 22. All other motions that follow the breaking of contact between pin 38*b* and teeth 22*s* are the same as were described above. It should also be noted that as pin 38*b* is moved downwardly in the direction of arrow "H" (in both methods of unlocking), spring 40 becomes compressed and first plate 38*c* is moved towards body 38*a* of solenoid. When power is cut from power pack 50, spring 40 will return to its uncompressed state (shown in FIG. 20). Since second flange 22*p* has by this time rotated in the direction "J" and away from surface 18*b*, pin 38*b* will no longer lock second flange 22*p* against motion in the direction of arrow "J" and so gun mounting lock 12 will remain ready and open for replacing gun 10 into the same.

In other instances it may be desirable to reconfigure the manner in which solenoid 38 works so that solenoid 38 keeps pin 38*b* engaged with teeth 22*s* on second flange 22*p* when solenoid 38 is powered. In these instances both solenoid 38 and spring 40 will urge pin 38*b* into interlocking engagement with teeth 22*s* when second flange 22*p* is in the position shown in FIG. 21. The only manner of unlocking gun mounting lock 12 will be to use the key 58 as described above. If there is a power failure then spring 40 will continue to urge pin 38*b* into engagement with teeth 22*s* and so gun mounting lock 12 will remain locked until key 58 is used to unlock gun mounting lock 12 in the manner previously described.

It should be understood that in some instances instead of the first and second arms 20, 22 and control arm 28 being mounted on a housing 18 that is then secured to a track 14, housing 18 may be directly secured to a support surface. In other instances housing 18 may itself be omitted and the first and second arms 20, 22, control arm 28, barrel lock 36 and solenoid 40 may all be provided as integral components of the support surface itself. So the arms 20, 22 and ratchet assembly may extend outwardly from apertures in a wall of a gun safe, for example.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. A gun mounting lock comprising:

a housing;

a first arm rotatably mounted on the housing, said first arm having an end provided with a first hub and at least one tooth extending outwardly from the first hub;

a second arm rotatably mounted on the housing; wherein the first arm is opposed to the second arm; wherein said second arm has an end provided with a second hub, and at least one tooth and a flange extend outwardly from the second hub; and said flange extends outwardly for a distance beyond the at least one tooth on the second hub, and said flange rotates in unison with the second hub;

a ratchet assembly provided on the; said ratchet assembly being operatively engaged with the at least one tooth of each of the first hub and the second hub; wherein the ratchet assembly is movable relative to the housing and when the ratchet assembly is moved in a first direction the first and second arms pivot in unison towards each other; and when the ratchet assembly is moved in a second direction the first and second arms pivot in unison away from each other; and a locking mechanism provided on the housing; wherein the flange extending outwardly from the second hub activates the locking mechanism when the ratchet assembly is moved in the first direction.

2. The gun mounting lock as defined in claim 1, wherein the body moves linearly in the first direction or the second direction.

3. The gun mounting lock as defined in claim 1, wherein the first and second arms each have an outer end remote from the associated one of the first hub and the second hub; and wherein the outer ends are offset relative to each other and align one behind the other when the first and second arms have pivoted toward each other.

4. The gun mounting lock as defined in claim 1, wherein the gun mounting lock is movable between a locked position and an unlocked position; and when in the locked position an outer end of the first arm and an outer end of the second arm are aligned with each other and are aligned along a vertical axis with the ratchet assembly; and when in the unlocked position, the outer ends of the first arm and the second arms are not aligned with each other.

5. The gun mounting lock defined in claim 1, wherein the locking mechanism includes:

a solenoid located in the housing in a position beneath the first hub;

a pin extending outwardly from the solenoid; wherein a portion of the flange contacts the pin when the ratchet assembly is moved in the first direction.

6. The gun mounting lock defined in claim 5, further comprising an actuator operatively engaged with the solenoid; wherein the actuator enables a user to selectively perform one of providing power to the solenoid and cutting power to the solenoid.

7. The gun mounting lock defined in claim 6, wherein the actuator comprises one of a direct activator provided on the housing; wherein the direct activator comprises one or more of a button, a keypad, a fingerprint pad, a retinal scanner, and a voice activator.

8. A gun mounting lock comprising:

a first arm; said first arm having an end provided with a first hub and at least one tooth extending outwardly from the first hub;

a second arm positioned opposite the first arm; wherein said second arm has an end provided with a second hub, and at least one tooth extends outwardly from the second hub;

a plunger positioned between the first hub and the second hub; said plunger comprising a base including a first side, an opposed second side, and a concavely curved top wall that is integral with and extends laterally between the first and second sides; and wherein the top wall moves in unison with the first and second sides; and wherein each of the first and second sides includes at least one tooth extending outwardly therefrom, wherein the at least one tooth on each of the first and second sides engages with the at least one tooth extending outwardly from an associated one of the first hub and the second hub wherein the plunger is movable in a first direction or a second direction; and when the plunger is moved in the first direction, an outer end of the first arm and an outer end of the second arm are caused to move towards each other; and when the plunger is moved in the second direction, the outer ends of the first and second arms move away from each other.

9. The gun mounting lock as defined in claim 8, wherein the plunger moves linearly in the first direction and in the second direction; and wherein the linear motion of the plunger is translated to rotational motion of the first and second arms.

10. The gun mounting lock as defined in claim 8, wherein the second side of the base includes a row of alternating teeth and troughs that engage the at least one tooth on the second hub; and wherein the second side of the base further defines a slot therein that is laterally spaced from the row of alternating teeth and troughs; and wherein a flange extends outwardly from the second hub and for a distance outwardly beyond the at least one tooth on the second hub, and the flange is received within the slot.

11. The gun mounting lock as defined in claim 10, further comprising a plurality of teeth on a terminal end of the flange.

12. The gun mounting lock as defined in claim 11, further comprising a solenoid having a pin; and wherein pin permits rotation of the flange in one direction but engages the teeth on the flange and prevents rotation of the flange in an opposite direction.

13. The gun mounting lock as defined in claim 12, further comprising a lock provided on the housing; wherein the lock includes a first face that is located on an exterior surface of the housing and is adapted to receive a key therein; and wherein a portion of the lock engages a plate that is connected to the pin of the solenoid; and wherein unlocking of the lock with the key causes the portion of the lock to move the plate and thereby the pin, withdrawing the pin from engagement with the teeth on the flange.

14. The gun mounting lock as defined in claim 12, further comprising a power source connected to the solenoid; and wherein the power source provides current to the solenoid and when powered the solenoid unlocks the gun mounting lock.

15. The gun mounting lock as defined in claim 8, wherein the first and second hubs rotate towards each other when the ratchet assembly is moved in the first direction; and the first and second hubs rotate away from each other when the ratchet assembly is moved in the second direction.

16. The gun mounting lock as defined in claim 8, further comprising a housing; wherein the first and second hubs and a lower end of the ratchet assembly are received within an interior cavity of the housing; and wherein the ratchet assembly moves upwardly and downwardly relative to an outer wall of the housing.

17. The gun mounting lock as defined in claim 8, further comprising a track adapted to be mounted to a support surface; and wherein the housing is engageable with the track.

18. A method of using a gun mounting lock to secure a gun to a support surface comprising:

providing a gun mounting lock comprising a first arm having a first hub at one end with at least one tooth extending outwardly therefrom; a second arm positioned opposite the first arm where the second arm has a second hub at one end with at least one tooth extending outwardly therefrom; and a plunger positioned between and operatively engaged with the first hub of the first arm and the second hub of the second arm; where the plunger includes a top wall that is integral with and extends between a first side and a second wall, where each of the first and second sides includes at least one tooth extending outwardly therefrom;

placing a part of the gun onto the top wall of the plunger;

applying a downward force on the top wall of the plunger;

moving the top wall and the first and second sides of the plunger downwardly in unison;

translating a downward motion of the plunger as a result of downward force into a rotational motion of the lower ends of the first arm and the second arm; and wherein the rotational motion includes:

rotating the lower end of the first arm about a first axis;

rotating the lower end of the second arm about a second axis;

pivoting an upper end of the first arm towards an upper end of the second arm;

pivoting the upper end of the second arm toward the upper end of the second arm; and capturing the part of the gun between the upper ends of the first and second arms and the upper surface of the plunger.

19. The method as defined in claim 18, wherein the steps of rotating the lower ends of the first and second arms occurs simultaneously.

20. The method as defined in claim 18, wherein the steps of pivoting the upper ends of the first and second arms occurs simultaneously.

21. The method as defined in claim 18, further comprising;

receiving a projection on the upper end of the first arm in a notch defined in the upper end of the second arm; and receiving a projection on the upper end of the second arm in a notch defined in the upper end of the first arm.

22. The method as defined in claim 18, further comprising bringing a projection on the upper end of the first arm into alignment with a projection on the upper end of the second arm.

23. The method as defined in claim 22, further comprising; bringing the projections on the upper ends of the first and second arm into alignment with the plunger.

24. The method as defined in claim 18, wherein the method further comprises:

interlocking the at least one tooth provided on the first side of the ratchet assembly opposite the first hub on the lower end of the first arm with the at least one tooth provided on the first hub of the first arm; and interlocking the at least one tooth provided on the second side of the ratchet assembly opposite the second hub on the lower end of the second arm with the at least one tooth provided on the second hub of the lower end of the second arm.

25. The method as defined in claim 24, further comprising:

rotating the first hub on the first arm toward the second hub on the second arm as the ratchet assembly is moved downwardly.

26. The method as defined in claim 24, further comprising:

rotating a flange that extends outwardly from the second hub of the second arm in unison with the second hub of the second arm;

rotating the second hub in one direction as the ratchet assembly is moved downwardly;

interlocking a pin of a solenoid on the gun mounting lock with teeth provided on the flange;

preventing rotation of the flange and thereby the second hub on the second arm in an opposite direction; and locking the gun mounting lock.

27. The method as defined in claim 26, further comprising:

unlocking the gun mounting lock by providing power to the solenoid;

moving the pin of the powered solenoid out of interlocking engagement with the teeth on the flange;

moving the ratchet assembly upwardly;

rotating the lower ends of the first and second arms away from each other in response to the upward movement of the ratchet assembly;

pivoting the first and second arms away from each other in response to the rotation of the lower ends of the first and second arms; and removing the gun from the ratchet assembly.

28. The method as defined in claim 26, further comprising:

inserting a key into a barrel lock provided on the gun mounting lock;

turning the key;

rotating a leg extending outwardly from the barrel lock;

applying a force with the leg to a plate connected to the pin of the solenoid;

moving the plate and thereby the pin away from the teeth on the flange;

moving the ratchet assembly upwardly;

rotating the lower ends of the first and second arms away from each other in response to the upward movement of the ratchet assembly;

pivoting the first and second arms away from each other in response to the rotation of the lower ends of the first and second arms; and removing the gun from the ratchet assembly.

* * * * *